US008531351B2

(12) United States Patent
Choi

(10) Patent No.: US 8,531,351 B2
(45) Date of Patent: Sep. 10, 2013

(54) MULTI PLASMA DISPLAY DEVICE

(75) Inventor: Manyong Choi, Gumi (KR)

(73) Assignee: LG Electronics Inc., Seoul (KR)

( * ) Notice: Subject to any disclaimer, the term of this patent is extended or adjusted under 35 U.S.C. 154(b) by 938 days.

(21) Appl. No.: 12/638,331

(22) Filed: Dec. 15, 2009

(65) Prior Publication Data

US 2011/0128208 A1 Jun. 2, 2011

(30) Foreign Application Priority Data

Nov. 27, 2009 (KR) ..... 10-2009-0115959

(51) Int. Cl.
*G09G 5/00* (2006.01)

(52) U.S. Cl.
USPC ..... 345/1.3; 345/1.1

(58) Field of Classification Search
None
See application file for complete search history.

(56) References Cited

U.S. PATENT DOCUMENTS

| | | | | |
|---|---|---|---|---|
| 6,483,482 | B1 | 11/2002 | Kim | 345/3.1 |
| 6,927,908 | B2 * | 8/2005 | Stark | 359/449 |
| 8,368,729 | B2 * | 2/2013 | Watanabe | 345/690 |
| 2002/0140629 | A1 | 10/2002 | Sundahl | 345/1.3 |
| 2006/0145942 | A1 * | 7/2006 | Maatta | 345/1.3 |
| 2010/0053028 | A1 * | 3/2010 | Hu | 345/1.3 |
| 2010/0238090 | A1 * | 9/2010 | Pomerantz et al. | 345/1.3 |

FOREIGN PATENT DOCUMENTS

| | | | |
|---|---|---|---|
| EP | 1 376 199 | A1 | 1/2004 |
| KR | 10-2004-0050433 | A | 6/2004 |
| WO | WO 2004-051691 | A1 | 6/2004 |

OTHER PUBLICATIONS

European Search Report dated Jun. 1, 2010 issued in Application No. 09 01 5447.

* cited by examiner

*Primary Examiner* — Luxi C Simpson
(74) *Attorney, Agent, or Firm* — KED & Associates LLP

(57) ABSTRACT

A multi plasma display device is disclosed. The multi plasma display device includes a first panel, a second panel adjacent to the first panel, and a lens unit positioned so that the lens unit commonly overlaps a portion of a front surface of the first panel and a portion of a front surface of the second panel in a boundary portion between the first panel and the second panel. The lens unit overlaps a seal layer of the first panel and a seal layer of the second panel and does not overlap a discharge cell of the first panel and a discharge cell of the second panel.

15 Claims, 26 Drawing Sheets

| $W_1$:T | width of seam | stripe pattern |
|---|---|---|
| 10:1 | ○ | ◎ |
| 10:2 | ◎ | ◎ |
| 10:3 | ◎ | ◎ |
| 10:4 | ◎ | ◎ |
| 10:5 | ◎ | ◎ |
| 10:6 | ◎ | ◎ |
| 10:7 | ◎ | ○ |
| 10:8 | ◎ | ○ |
| 10:9 | ◎ | × |
| 10:10 | ◎ | × |

(a)

(b)

MULTI PLASMA DISPLAY DEVICE

This application claims the benefit of Korean Patent Application No. 10-2009-0115959 filed on Nov. 27, 2009, the entire contents of which is incorporated herein by reference for all purposes as if fully set forth herein.

BACKGROUND OF THE INVENTION

1. Field of the Invention

Embodiments of the invention relate to a multi plasma display device.

2. Discussion of the Related Art

A multi plasma display device is a display device displaying an image on a plurality of plasma display panels positioned adjacent to one another. The multi plasma display device may display a large screen image using a plurality of small-sized plasma display panels

SUMMARY OF THE INVENTION

In one aspect, there is a multi plasma display device comprising a first panel, a second panel positioned adjacent to the first panel, and a lens unit positioned so that the lens unit commonly overlaps a portion of a front surface of the first panel and a portion of a front surface of the second panel in a boundary portion between the first panel and the second panel, wherein each of the first panel and the second panel includes a front substrate, a rear substrate positioned opposite the front substrate, a barrier rib that is positioned between the front substrate and the rear substrate to partition a discharge cell, and a seal layer between the front substrate and the rear substrate, wherein the lens unit overlaps the seal layer of the first panel and the seal layer of the second panel and does not overlap the discharge cell of the first panel and the discharge cell of the second panel.

The lens unit may allow a size of the boundary portion between the first and second panels to seem to be smaller than an actual size of the boundary portion through an optical operation of the lens unit.

One end of the lens unit may be positioned between the seal layer and an outermost barrier rib of the first panel, and the other end may be positioned between the seal layer and an outermost barrier rib of the second panel.

One end of the lens unit may be positioned in a portion overlapping an outermost barrier rib of the first panel, and the other end may be positioned in a portion overlapping an outermost barrier rib of the second panel.

The lens unit may include a plurality of protrusions on the surface of the lens unit.

Each of the plurality of protrusions may have substantially a triangle shape.

The lens unit may include a first portion overlapping the first panel and a second portion overlapping the second pane. A shape of each of the protrusions formed in the first portion may be different from a shape of each of the protrusions formed in the second portion.

A width of the lens unit may be greater than the size of the boundary portion.

The lens unit may include a plurality of first prisms in a first portion overlapping the first panel and a plurality of second prisms in a second portion overlapping the second panel. An angle between a first surface of the second prism adjacent to the first portion and a base of the lens unit may be less than an angle between a second surface of the second prism opposite the first surface and the base of the lens unit. An angle between a first surface of the first prism adjacent to the second portion and the base of the lens unit may be less than an angle between a second surface of the first prism opposite the first surface and the base of the lens unit.

A distance between a top of an outermost first prism of the first prisms and a top of an outermost second prism of the second prisms may be greater than a distance between tops of two adjacent first prisms of the first prisms and a distance between tops of two adjacent second prisms of the second prisms in a boundary portion between the first portion and the second portion.

The first prisms and the second prisms may be arranged in opposite directions.

The multi plasma display device may further comprise a black layer positioned in the boundary portion between the first panel and the second panel.

The black layer may be positioned at the side of at least one of the first panel and the second panel.

A width of the lens unit may be greater than a thickness of the lens unit.

A ratio of the width to the thickness of the lens unit may be 10:1 to 10:8. The ratio of the width to the thickness of the lens unit may be 10:2 to 10:6.

In another aspect, there is a multi plasma display device comprising a first panel, a second panel positioned adjacent to the first panel, a black layer positioned in a boundary portion between the first panel and the second panel, and an optical sheet on the black layer, the optical sheet including a plurality of prisms, wherein a width of the optical sheet is greater than a width of the black layer.

The black layer may be formed of an electrically conductive material.

The multi plasma display device may further comprise a first auxiliary frame positioned at the side of the first panel in a boundary portion between the first panel and the second panel, and a second auxiliary frame positioned at the side of the second panel in the boundary portion between the first panel and the second panel. The optical sheet may be positioned so that the optical sheet commonly overlaps the first auxiliary frame and the second auxiliary frame.

A first film filter including a first electromagnetic shielding layer may be positioned on a front surface of the first panel, and a second film filter including a second electromagnetic shielding layer may be positioned on a front surface of the second panel. The first auxiliary frame may be connected to the first electromagnetic shielding layer, and the second auxiliary frame may be connected to the second electromagnetic shielding layer.

The black layer may be positioned at the side of at least one of the first panel and the second panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

Figure 1:
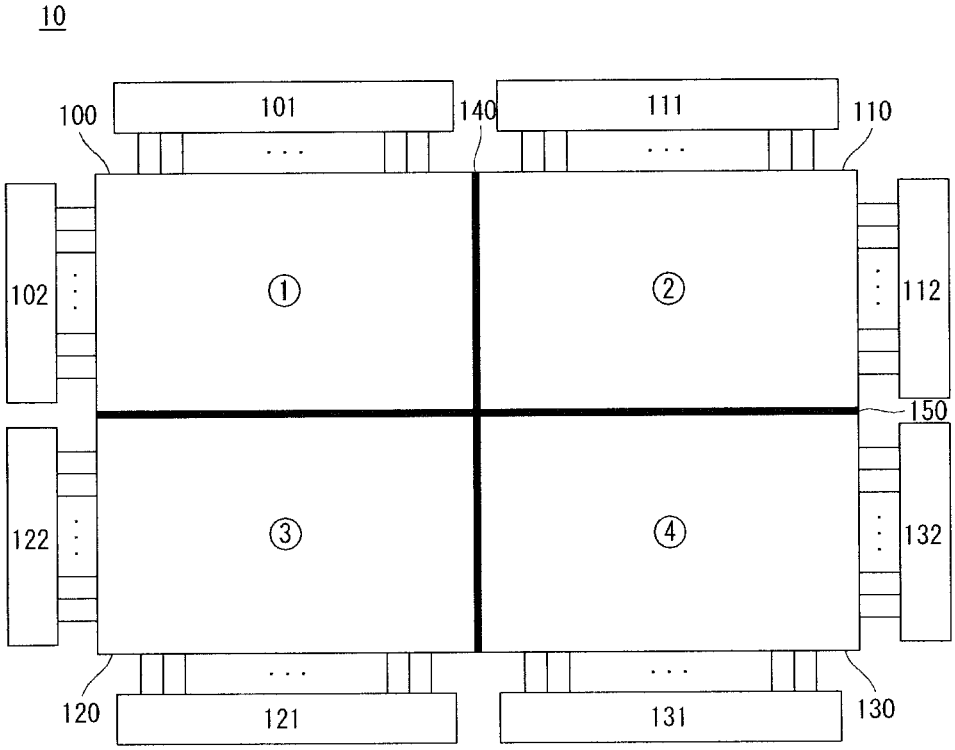
FIG. 1 illustrates a configuration of a multi plasma display device according to an embodiment of the invention.

FIG. 1 illustrates a configuration of a multi plasma display device according to an embodiment of the invention.

As shown in FIG. 1, a multi plasma display device 10 according to an embodiment of the invention includes a plurality of plasma display panels 100, 110, 120, and 130 positioned adjacent to one another.

Among the plurality of plasma display panels 100, 110, 120, and 130, a 1-1 driver 101 and a 1-2 driver 102 supply driving signals to the first plasma display panel 100. The 1-1 driver 101 and the 1-2 driver 102 are integrated into an integrated driver. Further, a 2-1 driver 111 and a 2-2 driver 112 supply driving signals to the second plasma display panel 110. In other words, the plasma display panels 100, 110, 120, and 130 may be structured so that a different driver supplies a driving signal to each of the plasma display panels 100, 110, 120, and 130.

Seam portions 140 and 150 are formed between two adjacent plasma display panels of the plurality of plasma display panels 100, 110, 120, and 130. The seam portions 140 and 150 may be called regions between the two adjacent plasma display panels.

In the multi plasma display device 10, because an image is displayed on the plurality of plasma display panels 100, 110, 120, and 130 positioned adjacent to one another, the seam portions 140 and 150 may be formed between two adjacent plasma display panels.

Figure 2:
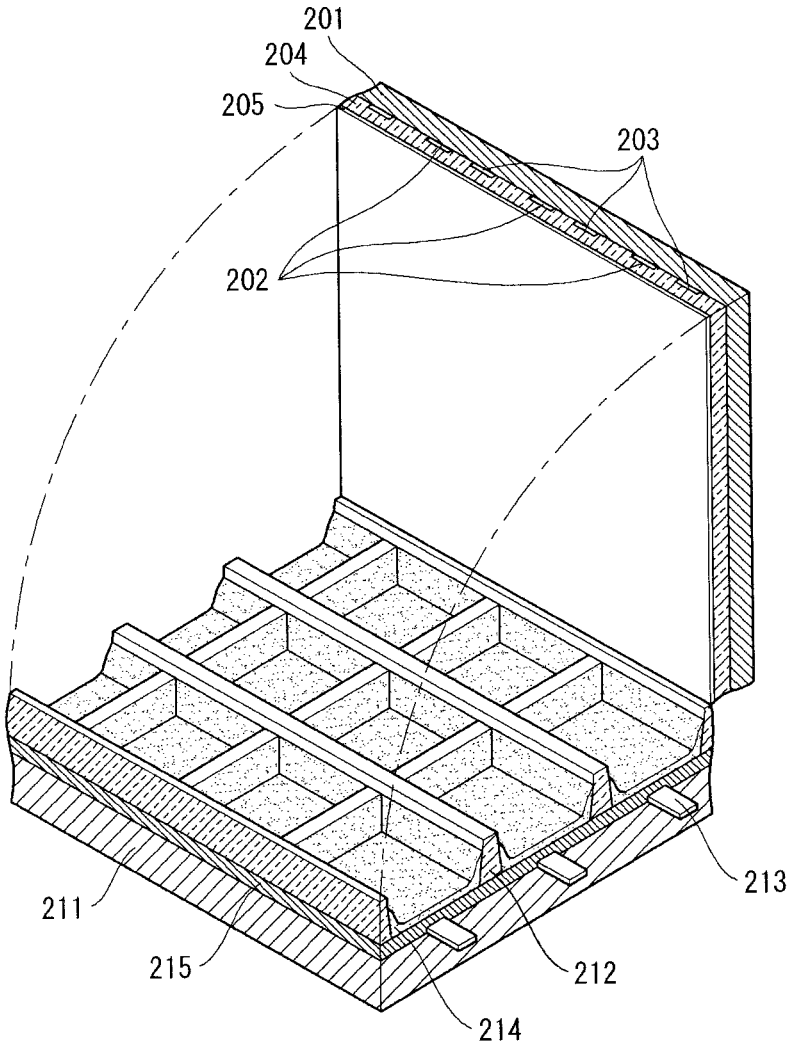
FIGS. 2 to 4 illustrate a structure and a driving method of a plasma display panel.
Figure 3:
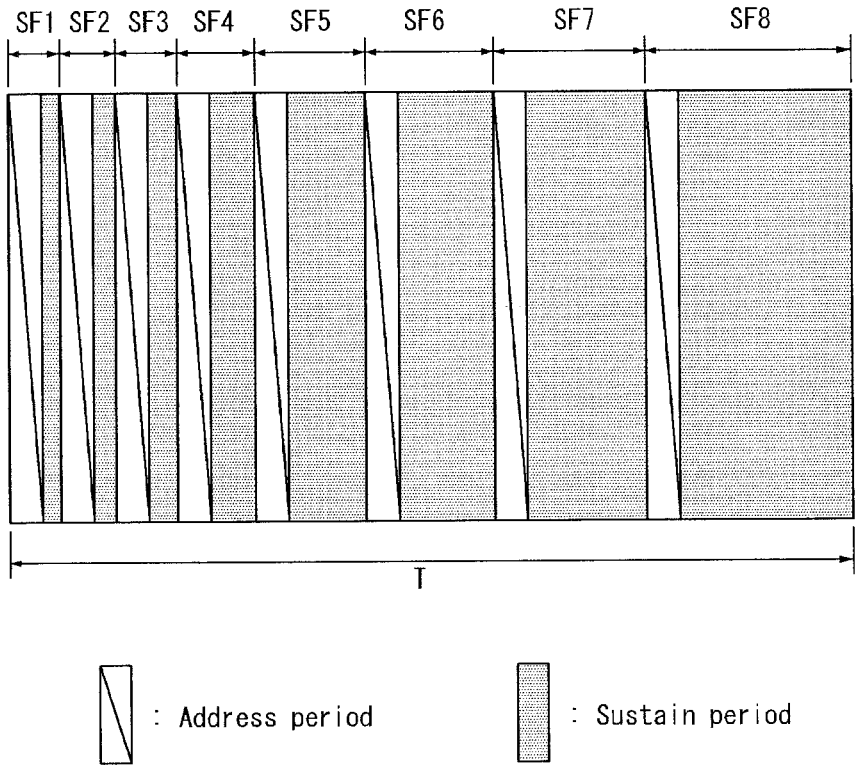
Figure 4:
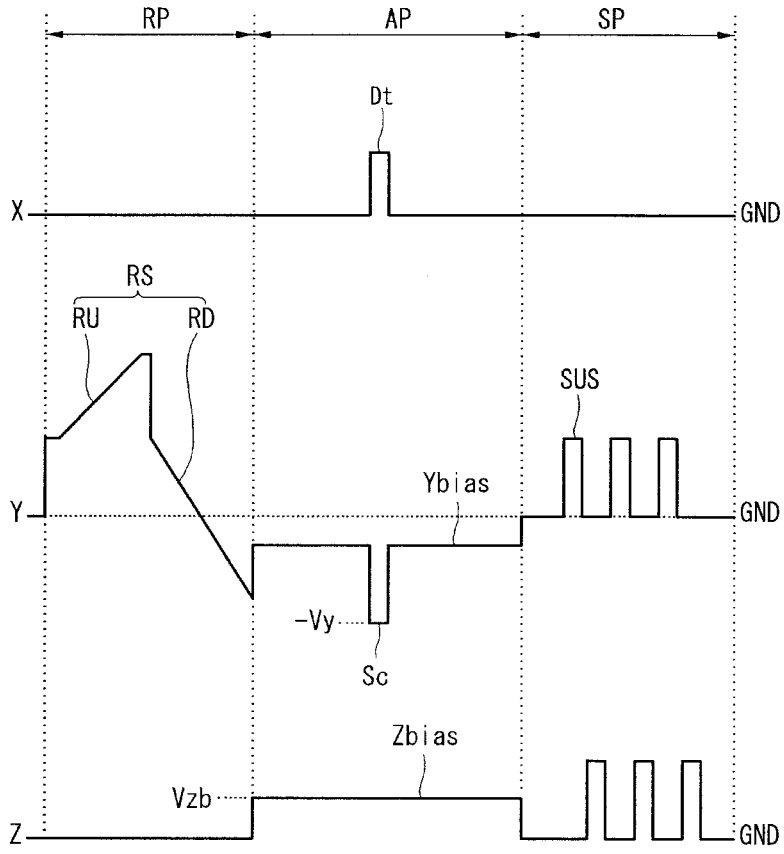

FIGS. 2 to 4 illustrate a structure and a driving method of a plasma display panel.

A plasma display panel may display an image in a frame including a plurality of subfields.

More specifically, as shown in FIG. 2, the plasma display panel may include a front substrate 201, on which a plurality of first electrodes 202 and 203 are formed, and a rear substrate 211 on which a plurality of second electrodes 213 are formed to cross the first electrodes 202 and 203.

In FIGS. 2 to 4, the first electrodes 202 and 203 may include scan electrodes 202 and sustain electrodes 203 substantially parallel to each other, and the second electrodes 213 may be called address electrodes.

An upper dielectric layer 204 may be formed on the scan electrode 202 and the sustain electrode 203 to limit a discharge current of the scan electrode 202 and the sustain electrode 203 and to provide insulation between the scan electrode 202 and the sustain electrode 203.

A protective layer 205 may be formed on the upper dielectric layer 204 to facilitate discharge conditions. The protective layer 205 may be formed of a material having a high secondary electron emission coefficient, for example, magnesium oxide (MgO).

A lower dielectric layer 215 may be formed on the address electrode 213 to provide insulation between the address electrodes 213.

Barrier ribs 212 of a stripe type, a well type, a delta type, a honeycomb type, etc. may be formed on the lower dielectric layer 215 to partition discharge spaces (i.e., discharge cells). Hence, a first discharge cell emitting red light, a second discharge cell emitting blue light, and a third discharge cell emitting green light, etc. may be formed between the front substrate 201 and the rear substrate 211. Each of the barrier ribs 212 may include first and second barrier ribs each having a different height.

The address electrode 213 may cross the scan electrode 202 and the sustain electrode 203 in one discharge cell. Namely, each discharge cell is formed at a crossing of the scan electrode 202, the sustain electrode 203, and the address electrode 213.

Each of the discharge cells partitioned by the barrier ribs 212 may be filled with a predetermined discharge gas.

A phosphor layer 214 may be formed inside the discharge cells to emit visible light for an image display during an address discharge. For example, first, second, and third phosphor layers that respectively generate red, blue, and green light may be formed inside the discharge cells.

While the address electrode 213 may have a substantially constant width or thickness, a width or thickness of the address electrode 213 inside the discharge cell may be different from a width or thickness of the address electrode 213 outside the discharge cell. For example, a width or thickness of the address electrode 213 inside the discharge cell may be larger than a width or thickness of the address electrode 213 outside the discharge cell.

When a predetermined signal is supplied to at least one of the scan electrode 202, the sustain electrode 203, and the address electrode 213, a discharge may occur inside the discharge cell. The discharge may allow the discharge gas filled in the discharge cell to generate ultraviolet rays. The ultraviolet rays may be incident on phosphor particles of the phosphor layer 214, and then the phosphor particles may emit visible light. Hence, an image may be displayed on the screen of the plasma display panel 100.

A frame for achieving a gray scale of an image displayed on the plasma display panel is described with reference to FIG. 3.

As shown in FIG. 3, a frame for achieving a gray scale of an image may include a plurality of subfields. Each of the plurality of subfields may be divided into an address period and a sustain period. During the address period, the discharge cells not to generate a discharge may be selected or the discharge cells to generate a discharge may be selected. During the sustain period, a gray scale may be achieved depending on the number of discharges.

For example, if an image with 256-gray level is to be displayed, as shown in FIG. 3, a frame may be divided into 8 subfields SF1 to SF8. Each of the 8 subfields SF1 to SF8 may include an address period and a sustain period.

Furthermore, at least one of a plurality of subfields of a frame may further include a reset period for initialization. At least one of a plurality of subfields of a frame may not include a sustain period.

The number of sustain signals supplied during the sustain period may determine a gray level of each of the subfields. For example, in such a method of setting a gray level of a first subfield at $2^0$ and a gray level of a second subfield at $2^1$, the sustain period increases in a ratio of $2^n$ (where, n=0, 1, 2, 3, 4, 5, 6, 7) in each of the subfields. Hence, various gray levels of an image may be achieved by controlling the number of sustain signals supplied during the sustain period of each subfield depending on a gray level of each subfield.

Although FIG. 3 shows that one frame includes 8 subfields, the number of subfields constituting a frame may vary. For example, a frame may include 10 or 12 subfields. Further, although FIG. 3 shows that the subfields of the frame are arranged in increasing order of gray level weight, the subfields may be arranged in decreasing order of gray level weight or may be arranged regardless of gray level weight.

At least one of a plurality of subfields of a frame may be a selective erase subfield, or at least one of the plurality of subfields of the frame may be a selective write subfield.

If a frame includes at least one selective erase subfield and at least one selective write subfield, it may be preferable that a first subfield or first and second subfields of a plurality of subfields of the frame is/are a selective write subfield and the other subfields are selective erase subfields.

In the selective erase subfield, a discharge cell to which a data signal is supplied during an address period is turned off during a sustain period following the address period. In other words, the selective erase subfield may include an address period, during which a discharge cell to be turned off is selected, and a sustain period during which a sustain discharge occurs in the discharge cell that is not selected during the address period.

In the selective write subfield, a discharge cell to which a data signal is supplied during an address period is turned on during a sustain period following the address period. In other words, the selective write subfield may include a reset period during which discharge cells are initialized, an address period during which a discharge cell to be turned on is selected, and a sustain period during which a sustain discharge occurs in the discharge cell selected during the address period.

A driving waveform for driving the plasma display panel is illustrated in FIG. 4.

As shown in FIG. 4, a reset signal RS may be supplied to the scan electrode Y during a reset period RP for initialization of at least one of a plurality of subfields of a frame. The reset signal RS may include a ramp-up signal RU with a gradually rising voltage and a ramp-down signal RD with a gradually falling voltage.

More specifically, the ramp-up signal RU may be supplied to the scan electrode Y during a setup period of the reset period RP, and the ramp-down signal RD may be supplied to the scan electrode Y during a set-down period following the setup period SU. The ramp-up signal RU may generate a weak dark discharge (i.e., a setup discharge) inside the discharge cells. Hence, the wall charges may be uniformly distributed inside the discharge cells. The ramp-down signal RD subsequent to the ramp-up signal RU may generate a weak erase discharge (i.e., a set-down discharge) inside the discharge cells. Hence, the remaining wall charges may be uniformly distributed inside the discharge cells to the extent that an address discharge occurs stably.

During an address period AP following the reset period RP, a scan reference signal Ybias having a voltage greater than a minimum voltage of the ramp-down signal RD may be supplied to the scan electrode Y. In addition, a scan signal Sc falling from a voltage of the scan reference signal Ybias may be supplied to the scan electrode Y.

A pulse width of a scan signal supplied to the scan electrode during an address period of at least one subfield of a frame may be different from pulse widths of scan signals supplied during address periods of the other subfields of the frame. A pulse width of a scan signal in a subfield may be greater than a pulse width of a scan signal in a next subfield. For example, a pulse width of the scan signal may be gradually reduced in the order of 2.6 μs, 2.3 μs, 2.1 μs, 1.9 μs, etc. or may be reduced in the order of 2.6 μs, 2.3 μs, 2.3 μs, 2.1 μs, . . . 1.9 μs, 1.9 μs, etc. in the successively arranged subfields.

As above, when the scan signal Sc is supplied to the scan electrode Y, a data signal Dt corresponding to the scan signal Sc may be supplied to the address electrode X. As a voltage difference between the scan signal Sc and the data signal Dt is added to a wall voltage obtained by the wall charges produced during the reset period RP, an address discharge may occur inside the discharge cell to which the data signal Dt is supplied. In addition, during the address period AP, a sustain reference signal Zbias may be supplied to the sustain electrode Z, so that the address discharge efficiently occurs between the scan electrode Y and the address electrode X.

During a sustain period SP following the address period AP, a sustain signal SUS may be supplied to at least one of the scan electrode Y or the sustain electrode Z. For example, the sustain signal SUS may be alternately supplied to the scan electrode Y and the sustain electrode Z. Further, the address electrode X may be electrically floated during the sustain period SP. As the wall voltage inside the discharge cell selected by performing the address discharge is added to a sustain voltage Vs of the sustain signal SUS, every time the sustain signal SUS is supplied, a sustain discharge, i.e., a display discharge may occur between the scan electrode Y and the sustain electrode Z.

FIGS. 5 to 24 illustrate an optical sheet.

Figure 5:
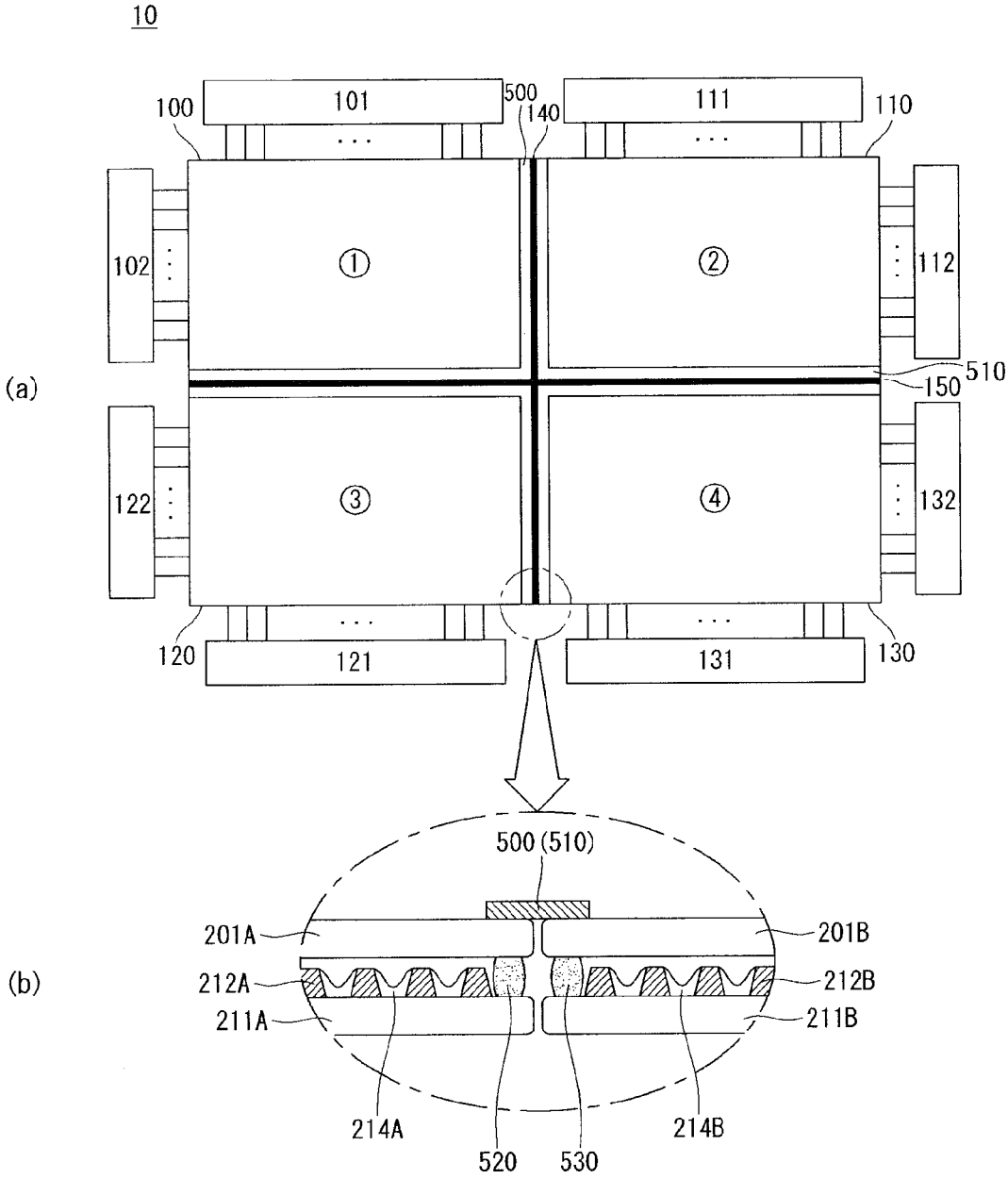
FIGS. 5 to 24 illustrate an optical sheet.

As shown in (a) of FIG. 5, optical sheets 500 and 510 may be positioned in adjacent two boundary portions, i.e., the seam portions 140 and 150. The seam portions 140 and 150 seem to be smaller than the actual size of the seam portions 140 and 150 because of an optical operation of the optical sheets 500 and 510 (i.e., because the optical sheets 500 and 510 refract incident light). Considering that the optical sheets 500 and 510 refract the incident light, the optical sheets 500 and 510 may be called lens units.

Figure 7:
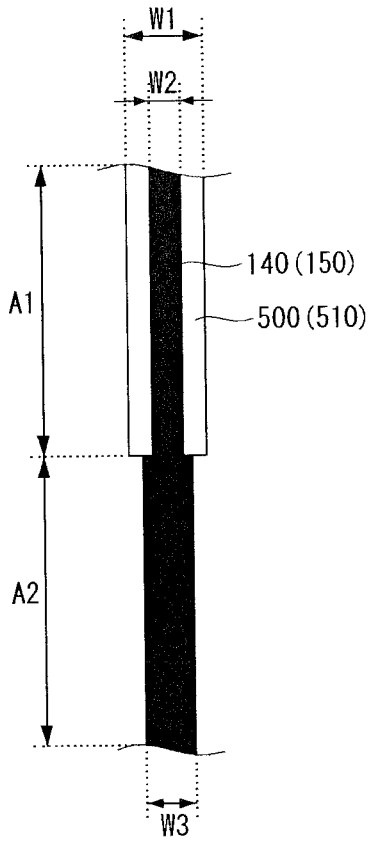

For example, as shown in FIG. 7, when the optical sheet 500(510) is not formed in an area A2, an observer may perceive a width of the seam portion 140(150) as W3. On the other hand, when the optical sheet 500(510) is formed on the seam portion 140(150) in an area A1, the observer may perceive the width of the seam portion 140(150) as W2 smaller than W3.

Further, the optical sheet 500(510) may partially overlap each of two plasma display panels adjacent to the optical sheet 500(510), so that the seam portions 140 and 150 seem to be smaller than the actual size of the seam portions 140 and 150.

The optical sheets 500 and 510 may be formed of a transparent material that is easy to mold. For example, the optical sheets 500 and 510 may be formed of acrylic material.

It is assumed that the multi plasma display device 10 includes the first panel 100, the second panel 110 positioned adjacent to the first panel 100, the third panel 120 positioned adjacent to the first panel 100, and the fourth panel 130 positioned adjacent to the second and third panels 110 and 120, as shown in FIG. 5. In this case, the first optical sheet 500 is positioned on the first seam portion 140 between the first and second panels 100 and 110 and between the third and fourth panels 120 and 130, and the second optical sheet 510 is positioned on the second seam portion 150 between the first and third panels 100 and 120 and between the second and fourth panels 110 and 130.

An image displayed on the two adjacent plasma display panels seems to be discontinuous because of the first and second seam portions 140 and 150.

In the embodiment, because the first and second seam portions 140 and 150 seem to be smaller than the actual size of the first and second seam portions 140 and 150 by respectively positioning the first and second optical sheets 500 and 510 on the first and second seam portions 140 and 150, the image displayed on the two adjacent plasma display panels seems to be more smoothly. Hence, the quality of the image displayed by the multi plasma display device 10 may be improved.

When the first to fourth panels 100 to 130 shown in (a) of FIG. 5 are the plasma display panels, the optical sheet 500 (510) may be positioned in a portion overlapping seal layers 520 and 530 of the two adjacent plasma display panels as shown in (b) of FIG. 5.

The seal layers 520 and 530 are used to attach front substrates 201A and 201B and rear substrates 211A and 211B of the two adjacent plasma display panels to each other, respectively. The image is not displayed on formation portions of the seal layers 520 and 530.

Thus, portions between the seal layers 520 and 530 of the two adjacent plasma display panels may be called the seam portions 140 and 150.

Although (b) of FIG. 5 shows that a space between the two adjacent plasma display panels is empty, an attaching layer or a buffer layer may be further positioned in the space.

Figure 6:
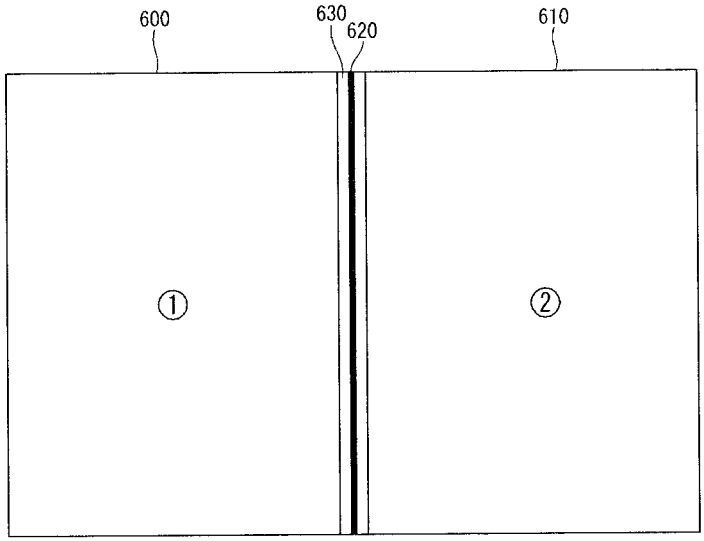

Further, although FIG. 5 shows the multi plasma display device 10 is comprised of the four plasma display panels 100 to 130, the multi plasma display device 10 may be comprised of two plasma display panels. For example, as shown in FIG. 6, when the multi plasma display device 10 is comprised of two plasma display panels 600 and 610, a seam portion 620 is positioned in a space between the two plasma display panels 600 and 610 and an optical sheet 630 is positioned on the seam portion 620.

Figure 8:
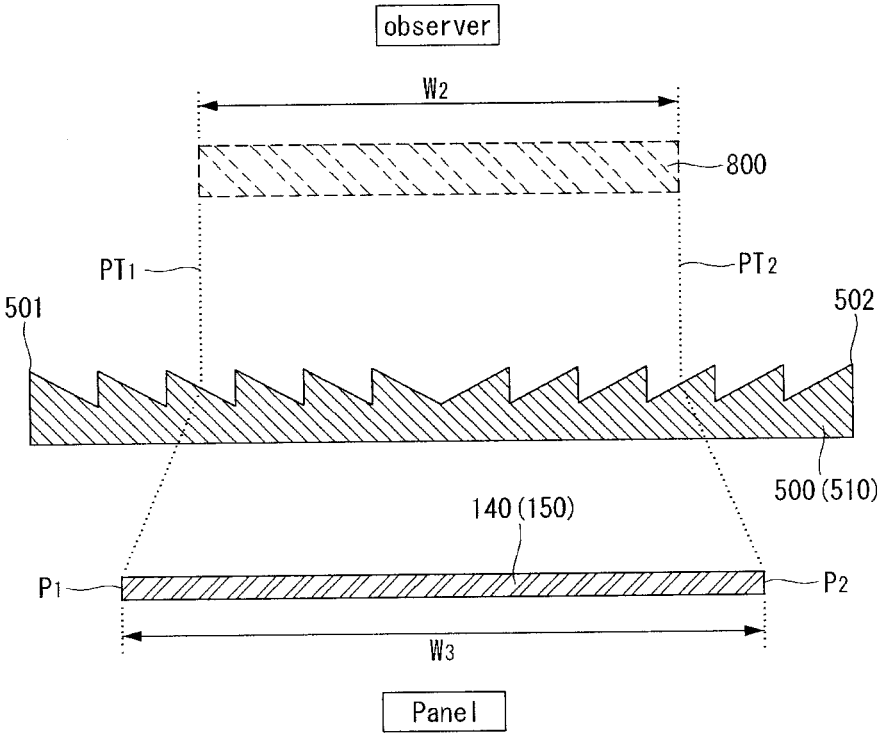

The optical sheets 500 and 510, as shown in FIG. 8, may include a plurality of protrusions 501 and 502 on the surfaces of the optical sheets 500 and 510, respectively.

The plurality of protrusions 501 and 502 may refract incident light at a predetermined angle. For this, the protrusions 501 and 502 may have a triangle shape. The triangle shape of the protrusions 501 and 502 may mean that the protrusions 501 and 502 have a substantial triangle shape as well as a mathematically perfect triangle shape.

For example, as shown in FIG. 8, it is assumed that the seam portion 140(150) having a width of W3 is positioned under the optical sheet 500(510). In this case, light starting from a first position P1 of the seam portion 140(150) travels along a first path PT1 through the first protrusions 501, and light starting from a second position P2 of the seam portion 140(150) travels along a second path PT2 through the second protrusions 502. Hence, the observer perceives the width of the seam portion 140(150) as W2 smaller than W3.

Because the first and second protrusions 501 and 502 refract light at a predetermined angle, the first and second protrusions 501 and 502 may be called prisms.

Figure 9:
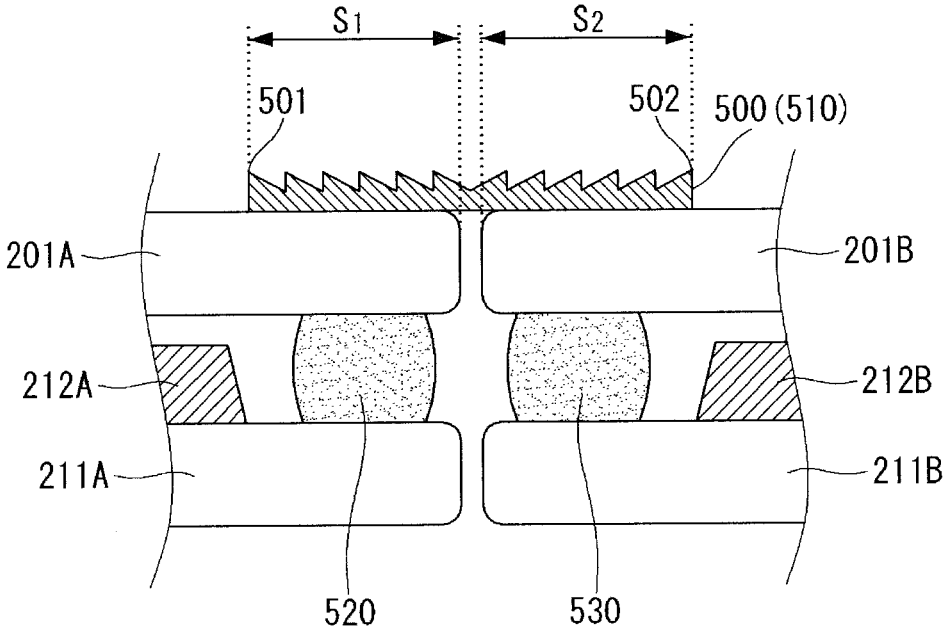

As shown in FIG. 9, the optical sheet 500(510) may include a first overlapping portion S1 between the optical sheet 500 (510) and a front substrate 201A of a first panel of two adjacent plasma display panels and a second overlapping portion S2 between the optical sheet 500(510) and a front substrate 201B of a second panel of the two adjacent plasma display panels. The first protrusions 501 are formed in the first overlapping portion S1, and the second protrusions 501 are formed in the second overlapping portion S2.

The first and second protrusions 501 and 502 may have different shapes, so that the first and second protrusions 501 and 502 refract incident light in different directions.

Figure 10:
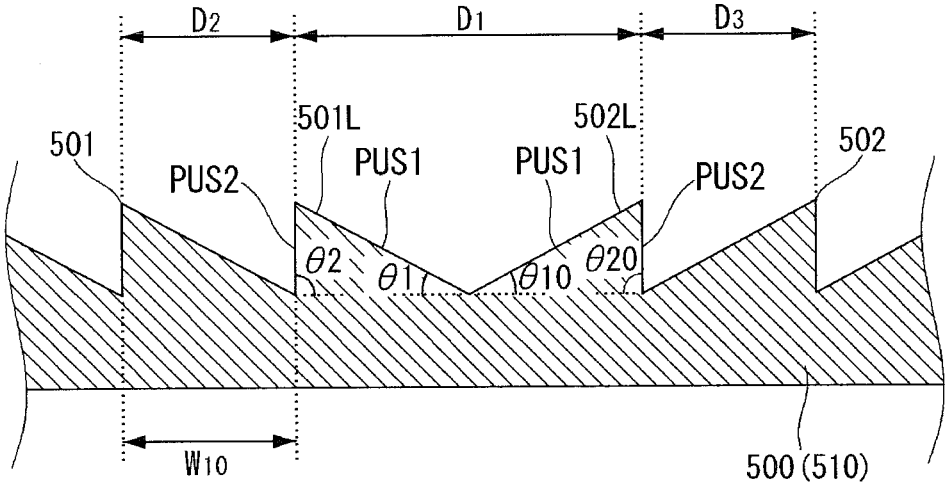

For example, as shown in FIGS. 9 and 10, an angle θ10 between a first surface PUS1 of the second protrusion 502 adjacent to the first portion S1 and the base of the optical sheet 500(510) may be smaller than an angle θ20 between a second surface PUS2 opposite the first surface PUS1 and the base of the optical sheet 500(510). Further, an angle θ1 between a first surface PUS1 of the first protrusion 501 adjacent to the second portion S2 and the base of the optical sheet 500(510) may be smaller than an angle θ2 between a second surface PUS2 opposite the first surface PUS1 and the base of the optical sheet 500(510).

In the embodiment, the angles θ2 and θ20 may be substantially equal to each other, and the angles θ1 and θ10 may be substantially equal to each other. A maximum difference between the angles θ2 and θ20 may be 4° and a maximum difference between the angles θ1 and θ10 may be 10° in consideration of an error in a manufacturing of the optical sheet.

When the angles θ1 and θ10 each have an excessively small value, a reduction effect in the visible size of the seam portions may be greatly reduced. Further, when the angles θ1 and θ10 each have an excessively large value, the observer may perceive the seam portion or the image through the first surface PUS1 of the protrusion when the observer observes the multi plasma display device at the side of the multi plasma display device. In other words, when the observer observes the multi plasma display device at the side of the multi plasma display device, the observer may look a striped pattern resulting from the optical sheet. Considering this, the angles θ1 and θ10 may be approximately 25° to 35°.

When the angles θ2 and θ20 each have an excessively small value, it is difficult to form the protrusions. Further, when the angles θ2 and θ20 each have an excessively large value, an image may run on the screen. Considering this, the angles θ2 and θ20 may be approximately 88° to 92°.

If the angles θ1 and θ10 are equal to each other and the angles θ2 and θ20 are equal to each other, the first and second protrusions 501 and 502 may be symmetric with respect to a Y-axis when a straight line perpendicular to the optical sheets 500 and 510 is called the Y-axis. In other words, the first and second protrusions 501 and 502 may be arranged in opposite directions.

When a width W10 of each protrusion has an excessively large value, the slight optical effect is obtained and it is difficult to form the first and second protrusions 501 and 502. Hence, the width W10 of each protrusion may be equal to or less than approximately 100 μm.

Because an outermost first protrusion SOIL and an outermost second protrusion 502L face each other in a portion where the first and second protrusions 501 and 502 are adjacent to each other, a distance D1 between a top of the outermost first protrusion SOIL and a top of the outermost second protrusion 502L may be greater than a distance D2 between tops of two adjacent first protrusions 501 and a distance D3 between tops of two adjacent second protrusions 502.

A thickness and a width of the optical sheet are described below.

Figures 11, 12:
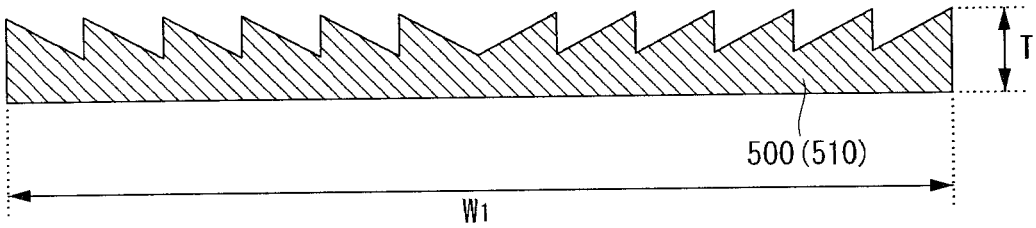

As shown in FIG. 11, a thickness T of the optical sheet 500(510) may be smaller than a width W1 of the optical sheet 500(510).

FIG. 12 is a graph illustrating a width of the seam portion and a striped pattern of the optical sheet depending on a ratio W1/T of the width W1 to the thickness T of the optical sheet 500(510).

Figure 13:
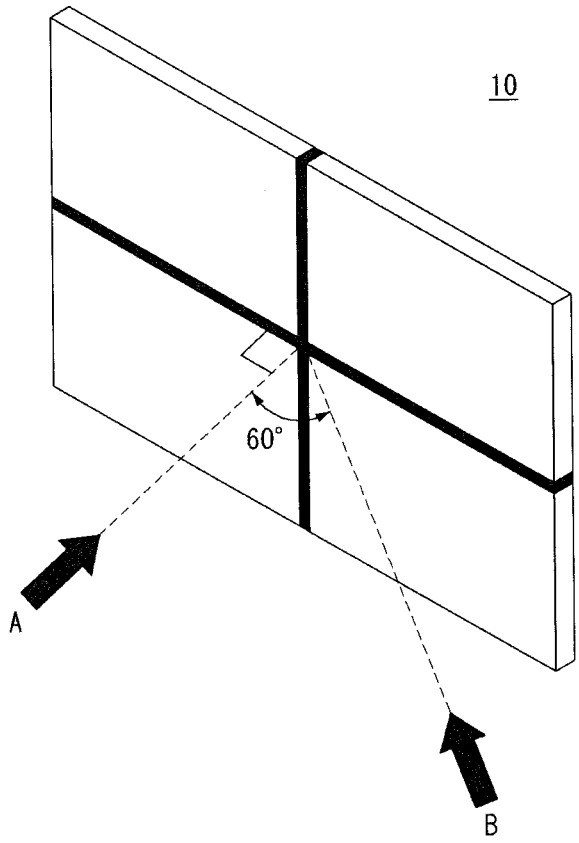

When the ratio W1/T of the width W1 to the thickness T of the optical sheet 500(510) changes from 10:1 to 10:10, many observers observed and evaluated changes in the width of the seam portion in the front of the multi plasma display device 10 (for example, a position "A" in FIG. 13).

Further, when the ratio W1/T of the width W1 to the thickness T of the optical sheet 500(510) changes from 10:1 to 10:10, the many observers observed and evaluated the generation of the striped pattern of the optical sheet 500(510) at a position moving from the front to the side of the multi plasma display device 10 by 60° (for example, a position "B" in FIG. 13).

In FIG. 12, X, ○, and ◎ represent bad, good, and excellent states of the characteristics, respectively.

As shown in FIG. 12, when the width to thickness ratio W1/T of the optical sheet 500(510) is 10:2 to 10:10, the state of the width of the seam portion was excellent. In other words, as the thickness of the optical sheet 500(510) increases, the width of the seam portion the observers felt becomes smaller.

Figure 14:
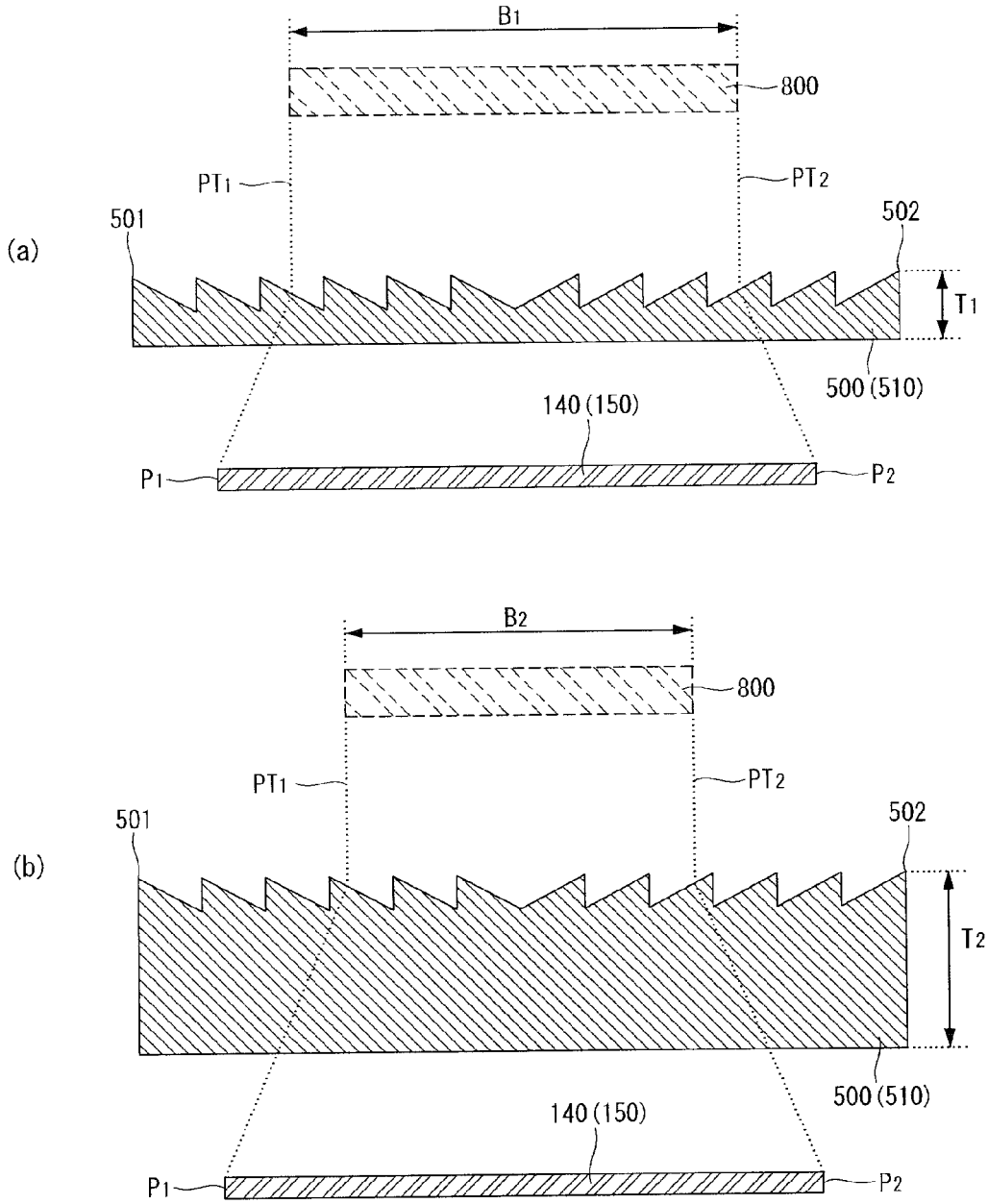

For example, as shown in (a) of FIG. 14, if the thickness of the optical sheet 500(510) is T1, the width of the seam portion the observer feels may be B1. Further, as shown in (b) of FIG. 14, if the thickness of the optical sheet 500(510) is T2 greater than T1, the width of the seam portion the observe feels may be B2 smaller than B1 because a travel distance of light inside the optical sheet 500(510) is longer than a travel distance of light in (a) of FIG. 14.

When the width to thickness ratio W1/T of the optical sheet 500(510) is 10:1, the state of the width of the seam portion was good.

Further, when the width to thickness ratio W1/T of the optical sheet 500(510) is 10:1 to 10:6, the generation state of the striped pattern of the optical sheet 500(510) was excellent. In other words, when the thickness T of the optical sheet 500(510) has a sufficiently small value, it is difficult for the observer to perceive the striped pattern resulting from the optical sheet 500(510) even if the observer observes the optical sheet 500(510) at a position moving from the front to the side of the multi plasma display device 10 by 60°.

On the other hand, when the width to thickness ratio W1/T of the optical sheet 500(510) is 10:9 to 10:10, the generation state of the striped pattern of the optical sheet 500(510) was bad.

Figure 15:
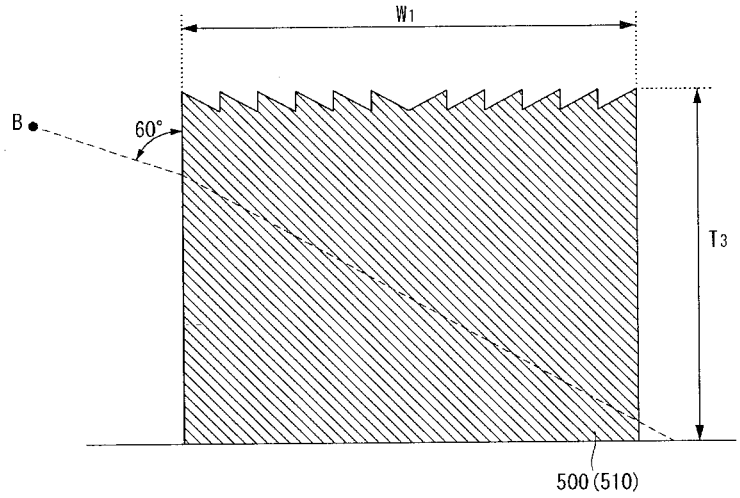

For example, as shown in FIG. 15, if the thickness of the optical sheet 500(510) is T3 and is excessively greater than the width W1 of the optical sheet 500(510), light incident on the optical sheet 500(510) at an angle of 60° at a position "B" may be transmitted from one side to the other side of the optical sheet 500(510). Hence, the observer at the position "B" may perceive that an image is displayed on the one side of the optical sheet 500(510). In other words, the observer may perceive that the striped pattern appears in the side of the optical sheet 500(510). In this case, the quality of an image displayed by the multi plasma display device 10 is reduced.

When the width to thickness ratio W1/T of the optical sheet 500(510) is 10:7 to 10:8, the generation state of the striped pattern of the optical sheet 500(510) was good. In this case, only some observers may perceive the striped pattern appears in the side of the optical sheet 500(510).

Considering the description of FIG. 12, the width to thickness ratio W1/T of the optical sheet 500(510) may be 10:1 to 10:8, and preferably, 10:2 to 10:6.

Figure 16:
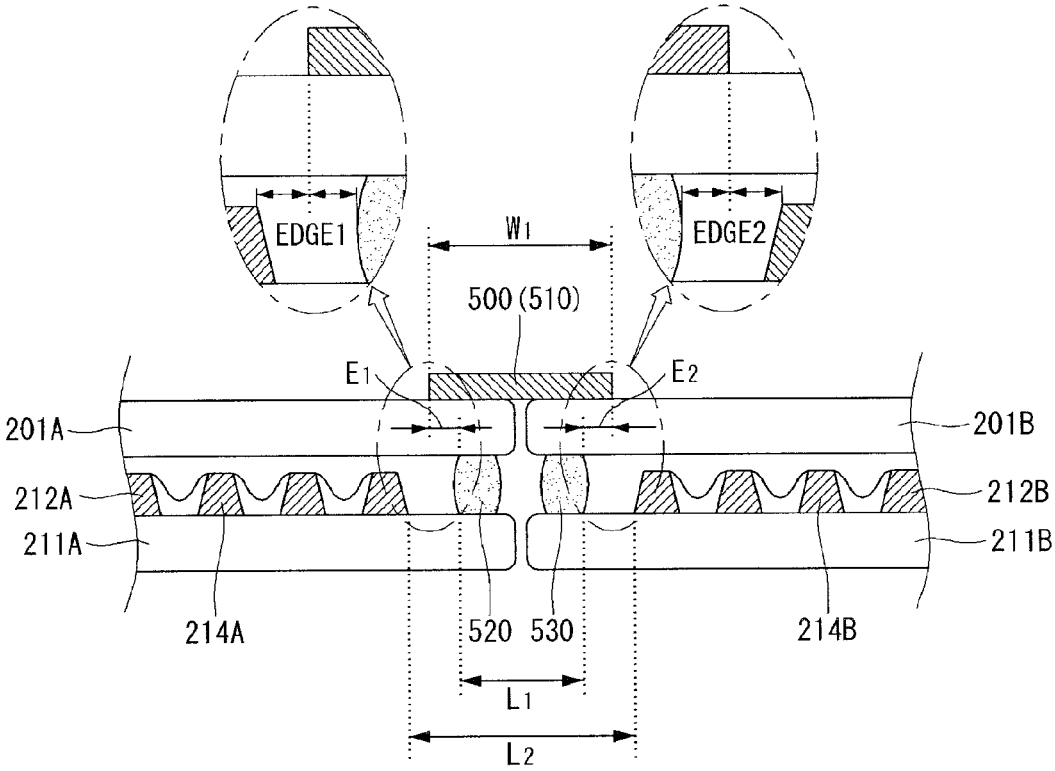

As shown in FIG. 16, the optical sheet 500(510) may overlap seal layers 520 and 530 of two plasma display panels adjacent to the optical sheet 500(510). In FIG. 16, the seal layer 520 is called a first seal layer, and the seal layer 530 is called a second seal layer. Further, it is assumed that first and second plasma display panels include the first and second seal layers 520 and 520, respectively.

A width W1 of the optical sheet 500(510) may be greater than a distance L1 between an end adjacent to a barrier rib 212A of the first panel among both ends of the first seal layer 520 and an end adjacent to a barrier rib 212B of the second panel among both ends of the second seal layer 530. Further, the width W1 of the optical sheet 500(510) may be smaller than a distance L2 between an outermost barrier rib 212A of the first panel and an outermost barrier rib 212B of the second panel. Thus, the optical sheet 500(510) may extend further than the first seal layer 520 by a length E1 in a middle direction of the first panel and may extend further than the second seal layer 530 by a length E2 in a middle direction of the second panel.

Further, while the optical sheet 500(510) overlaps the first seal layer 520 of the first panel, the optical sheet 500(510) may not overlap the discharge cell of the first panel. Preferably, while the optical sheet 500(510) overlaps the first seal layer 520 of the first panel, the optical sheet 500(510) may not overlap the phosphor layer formed in the discharge cell of the first panel. In addition, while the optical sheet 500(510) overlaps the second seal layer 530 of the second panel, the optical sheet 500(510) may not overlap the discharge cell of the second panel.

For this, one end EDGE1 of the optical sheet 500(510) may be positioned between the outermost barrier rib 212A and the first seal layer 520 of the first panel, and the other end EDGE2 of the optical sheet 500(510) may be positioned between the outermost barrier rib 212B and the second seal layer 530 of the second panel. In this case, the size of a boundary portion between the first panel and the second panel may be visually reduced while a distortion of the image in the boundary portion between the first panel and the second panel is suppressed.

Figure 17:
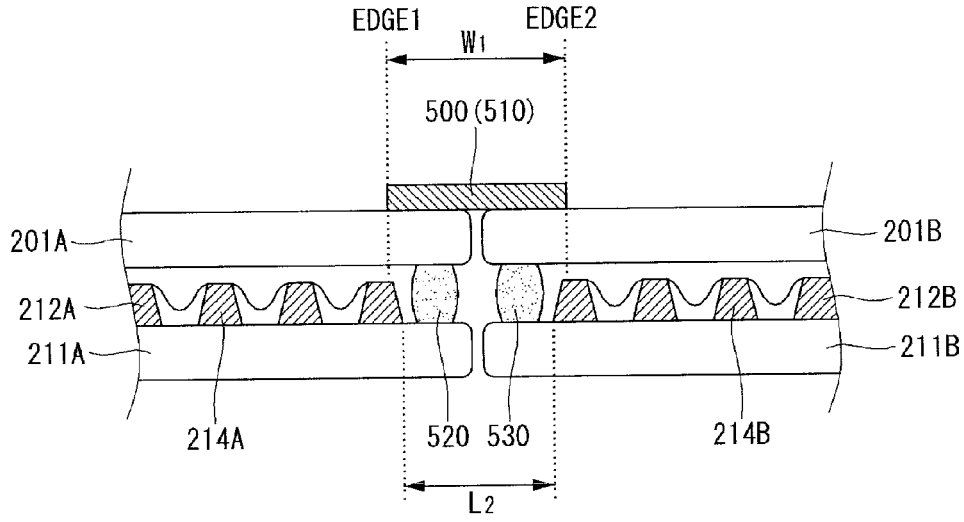

Alternatively, as shown in FIG. 17, while the optical sheet 500(510) overlaps the first and second seal layers 520 and 530, the optical sheet 500(510) may overlap at least one of an outermost barrier rib 212A of the first panel and an outermost barrier rib 212B of the second panel. Preferably, one end of the optical sheet 500(510) may be positioned in a portion overlapping the outermost barrier rib 212A of the first panel, and the other end of the optical sheet 500(510) may be positioned in a portion overlapping the outermost barrier rib 212B of the second panel. In this case, the width W1 of the optical sheet 500(510) may be greater than a distance L2 between the outermost barrier rib 212A of the first panel and the outermost barrier rib 212B of the second panel.

Figure 18:
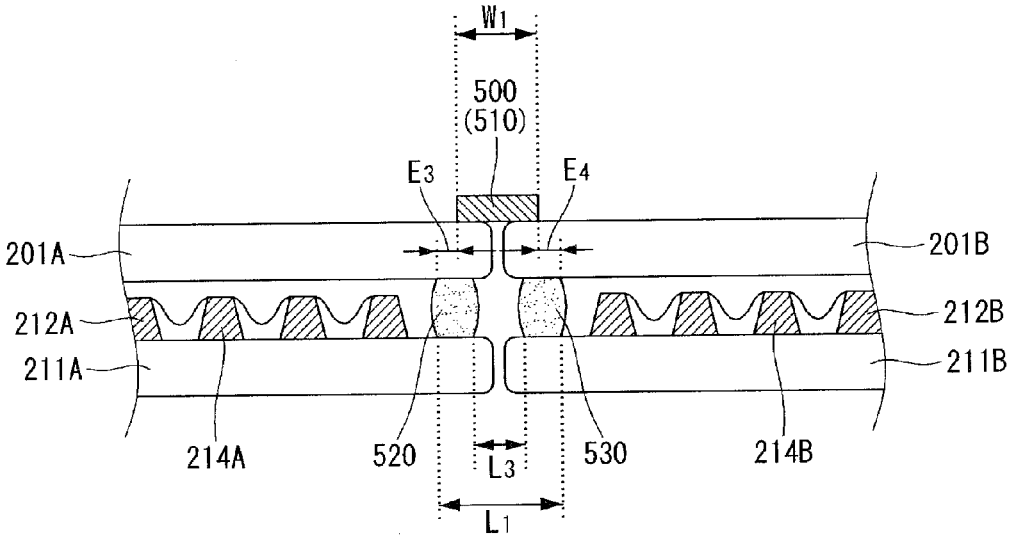

Alternatively, as shown in FIG. 18, while the optical sheet 500(510) overlaps the first and second seal layers 520 and 530, the width W1 of the optical sheet 500(510) may be greater than a distance L3 between the first and second seal layers 520 and 530. In this case, the width W1 of the optical sheet 500(510) may be smaller than a distance L1 between an end adjacent to the barrier rib 212A of the first panel among both ends of the first seal layer 520 and an end adjacent to the barrier rib 212B of the second panel among both ends of the second seal layer 530. Thus, the first seal layer 520 may extend further than the optical sheet 500(510) by a length E3 in a middle direction of the first panel, and the second seal layer 530 may extend further than the optical sheet 500(510) by a length E4 in a middle direction of the second panel.

Considering the descriptions of FIGS. 16 to 18, a boundary portion between the first panel and the second panel may mean a portion between the first seal layer 520 and the second seal layer 530, and the width W1 of the optical sheet 500(510) may be greater than a length of the boundary portion between the first panel and the second panel.

Figure 19:
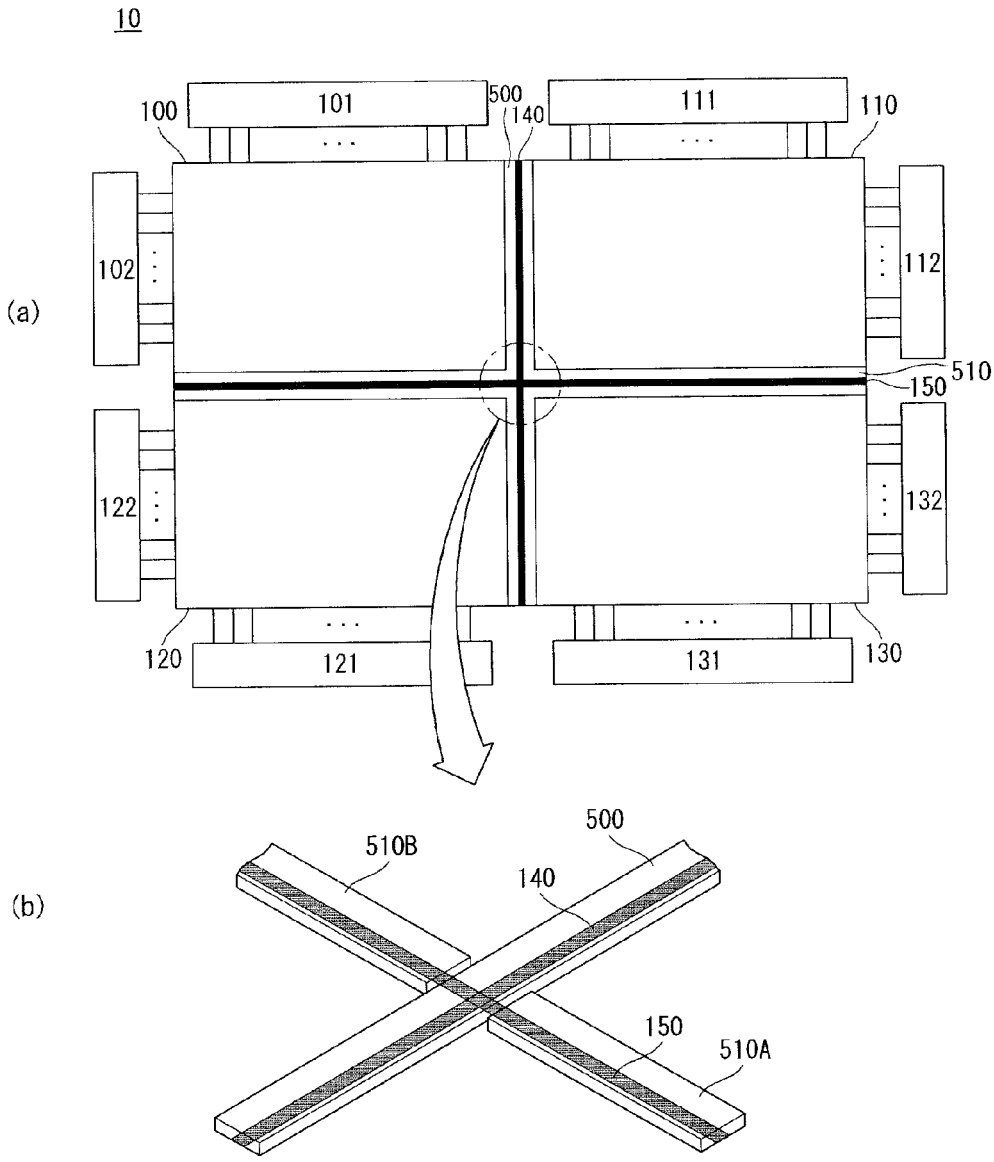

As shown in FIG. 19, the multi plasma display device 10 may include the first panel 100, the second panel 110 positioned adjacent to the first panel 100, the third panel 120 positioned adjacent to the first panel 100, and the fourth panel 130 positioned adjacent to the second and third panels 110 and 120. Further, the first optical sheet 500 may be positioned on the first seam portion 140 between the first and second panels 100 and 110 and between the third and fourth panels 120 and 130, and the second optical sheet 510 may be positioned on the second seam portion 150 between the first and third panels 100 and 120 and between the second and fourth panels 110 and 130.

Further, at least one of the first and second optical sheets 500 and 510 may be divided in a common boundary portion of the first to fourth panels 100 to 130. For example, as shown in FIG. 19, the second optical sheet 510 may be divided into a 2-1 optical sheet 510A and a 2-2 optical sheet 510B with the first optical sheet 500 interposed between the 2-1 optical sheet 510A and the 2-2 optical sheet 510B. In this case, after the first optical sheet 500 is positioned, the 2-1 optical sheet 510A and the 2-2 optical sheet 510B may be sequentially positioned.

Figure 20:
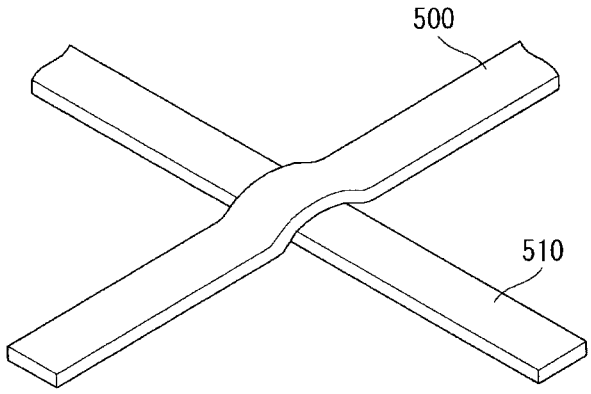

Alternatively, as shown in FIG. 20, the first optical sheet 500 and the second optical sheet 510 may overlap each other in a common boundary portion of the first to fourth panels 100 to 130. In this case, a formation process of the first and second optical sheets 500 and 510 may be simplified.

Figure 21:
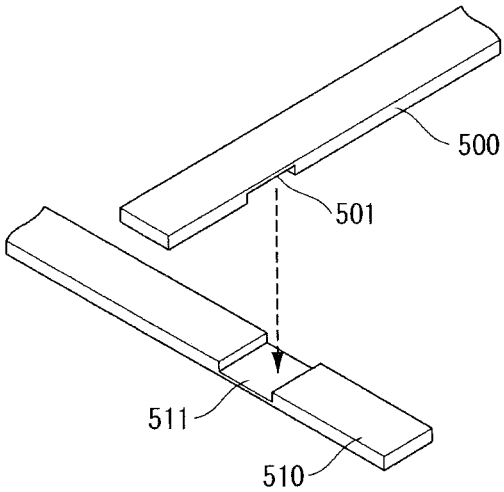

Alternatively, as shown in FIG. 21, while the first optical sheet 500 and the second optical sheet 510 overlap each other, at least one of the first and second optical sheets 500 and 510 may have a groove in an overlapping portion between the first and second optical sheets 500 and 510. For example, as shown in FIG. 21, the first optical sheet 500 has a first groove 501, the second optical sheet 510 has a second groove 511, and the first groove 501 of the first optical sheet 500 and the second groove 511 of the second optical sheet 510 may be engaged with each other. In this case, an overlapping portion between the first optical sheet 500 and the second optical sheet 510 may be prevented from being excessively thick.

Figure 22:
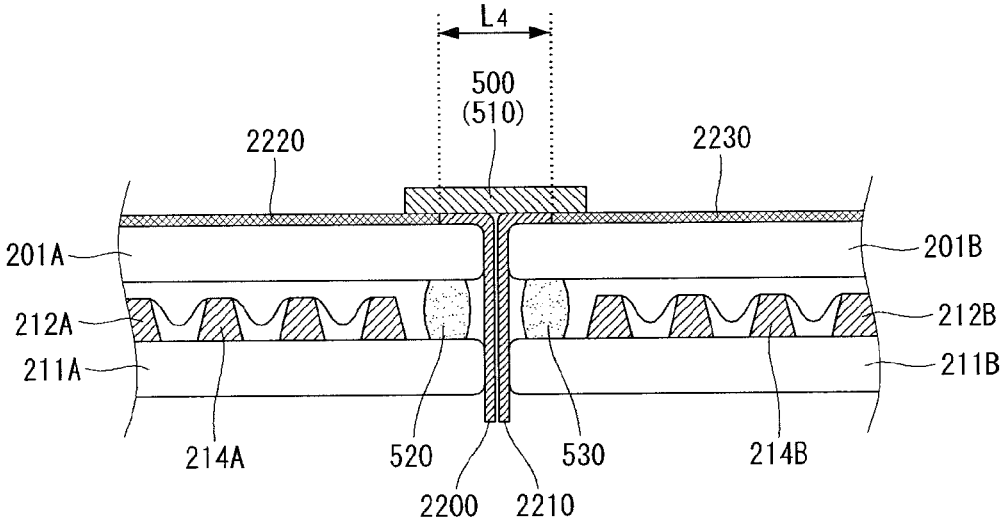

Alternatively, as shown in FIG. 22, the multi plasma display device may include a first filter 2220 on the front substrate 201A of the first panel and a second filter 2230 on the front substrate 201B of the second panel. The first filter 2220 and the second filter 2230 may be film filters. Although it is not shown, each of the first filter 2220 and the second filter 2230 may include an electromagnetic shielding layer for reducing electromagnetic interference. The electromagnetic shielding layer may be formed of a metal material.

Further, the multi plasma display device 10 may include first and second auxiliary frames 2200 and 2210 for grounding the electromagnetic shielding layers of the first filter 2220 and the second filter 2230. The first and second auxiliary frames 2200 and 2210 may be formed of a metal material with excellent electrical conductivity, for example, aluminum (A1). The first auxiliary frame 2200 may be positioned at the side of the first panel, and the second auxiliary frame 2210 may be positioned at the side of the second panel.

In addition, one end of the first auxiliary frame 2200 may be connected to the electromagnetic shielding layer of the first filter 2220, and the other end of the first auxiliary frame 2200 may be connected to a main frame positioned in the rear of a rear substrate 211A although it is not shown. One end of the second auxiliary frame 2210 may be connected to the electromagnetic shielding layer of the second filter 2230, and the other end of the second auxiliary frame 2210 may be connected to a main frame positioned in the rear of a rear substrate 211B although it is not shown.

Thus, the electromagnetic shielding layer of the first filter 2220 may be grounded by the first auxiliary frame 2200, and the second filter 2230 of the second filter 2230 may be grounded by the second auxiliary frame 2210.

In such a structure, the optical sheet 500(510) may be positioned on the first and second auxiliary frames 2200 and 2210, so that the optical sheet 500(510) commonly overlaps the first and second auxiliary frames 2200 and 2210. In this case, the width W1 of the optical sheet 500(510) may be greater than a distance L4 between a connection portion between the first auxiliary frame 2200 and the first filter 2220 and a connection portion between the second auxiliary frame 2210 and the second filter 2230.

Figure 23:
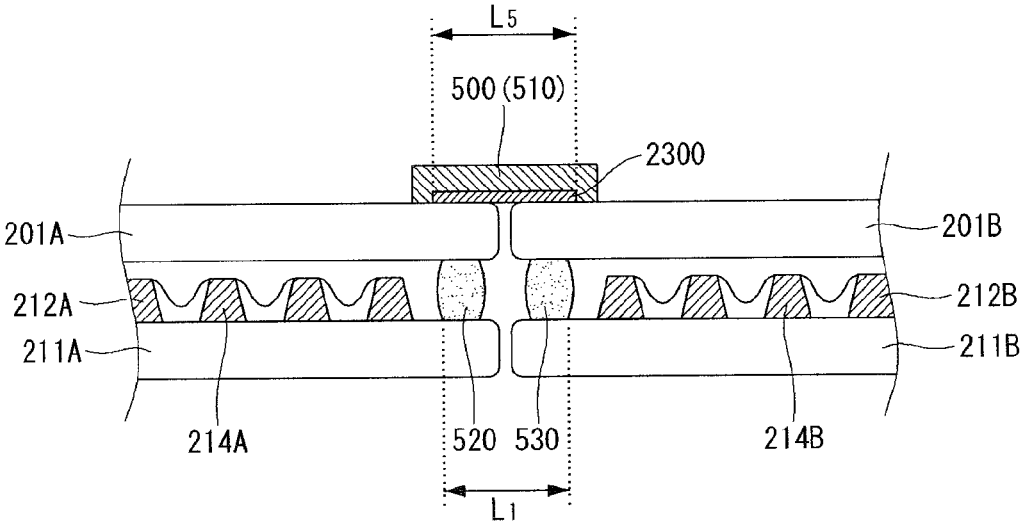

Alternatively, as shown in FIG. 23, a black layer 2300 may be positioned in a boundary portion between the first panel and the second panel to commonly overlap the front substrate 201A of the first panel and the front substrate 201B of the second panel. In this case, the black layer 2300 may improve contrast characteristic of the multi plasma display device 10. Further, the width W1 of the optical sheet 500(510) may be greater than a width L5 of the black layer 2300.

Figure 24:
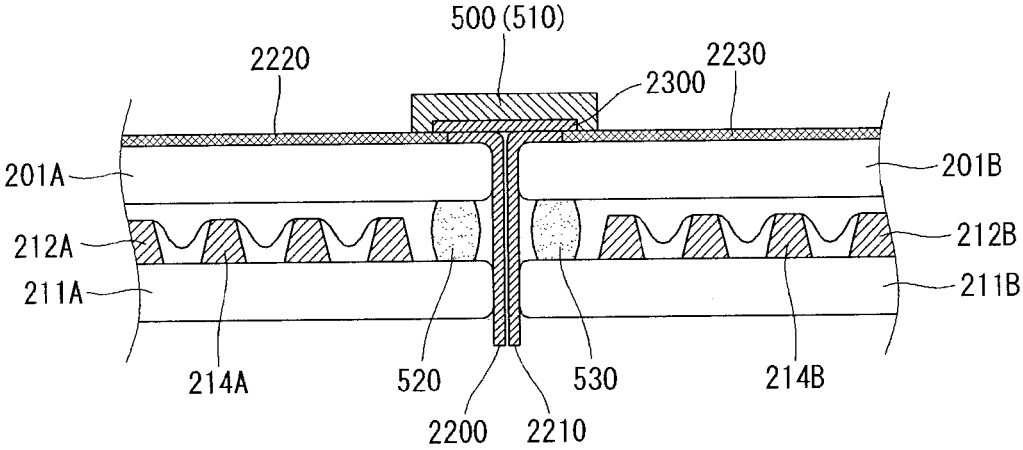

Alternatively, as shown in FIG. 24, a black layer 2300 may be positioned on the first and second auxiliary frames 2200 and 2210, and the optical sheet 500(510) may be positioned on the black layer 2300. The black layer 2300 may be formed of a material with excellent electrical conductivity. In this case, the black layer 2300 may allow the electromagnetic shielding layer of the first filter 2220 to be more efficiently connected to the first auxiliary frame 2200 and may allow the electromagnetic shielding layer of the second filter 2230 to be more efficiently connected to the second auxiliary frame 2210.

Figure 25:
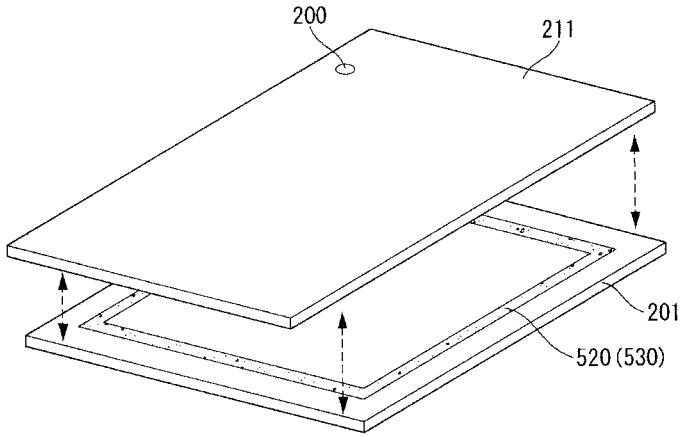
FIGS. 25 and 26 illustrate a method of manufacturing a multi plasma display device according to an embodiment of the invention.
Figure 25:
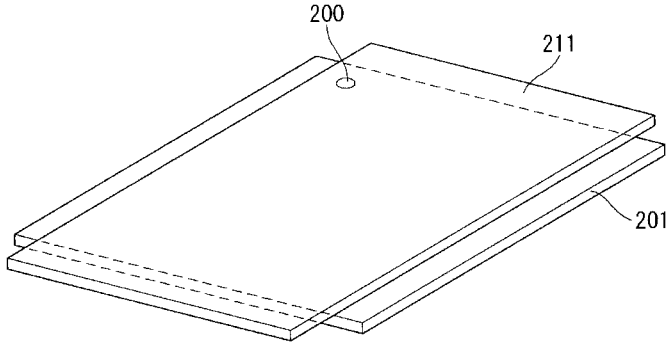
Figure 26:
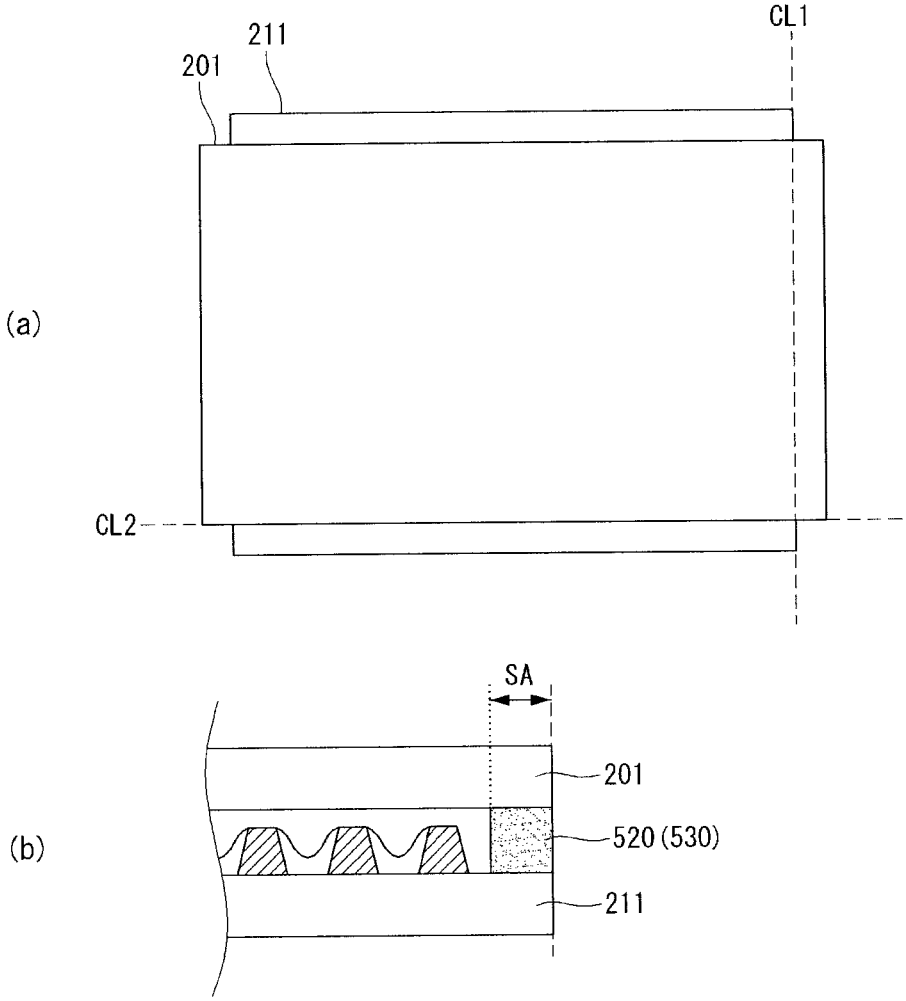

FIGS. 25 and 26 illustrate a method of manufacturing the multi plasma display device according to the embodiment of the invention.

As shown in (a) of FIG. 25, a seal layer 520(530) may be formed at an edge of at least one of a front substrate 201 and a rear substrate 211 on which an exhaust hole 200 is formed. Thus, as shown in (b) of FIG. 25, the front substrate 201 and the rear substrate 211 may be attached to each other through the seal layer 520(530).

Subsequently, an exhaust tip (not shown) may be connected to the exhaust hole 200, and an exhaust pump (not shown) may be connected to the exhaust tip. The exhaust pump may exhaust an impurity gas remaining in a discharge space between the front substrate 201 and the rear substrate 211 to the outside and may inject a discharge gas, such as argon (Ar), neon (Ne), and xenon (Xe), into the discharge space. The discharge space between the front substrate 201 and the rear substrate 211 may be sealed through the above-described method.

Subsequently, as shown in (a) of FIG. 26, at least one of the front substrate 201 and the rear substrate 211 may be cut along predetermined cutting lines CL1 and CL2 and may be ground in a state where the front substrate 201 and the rear substrate 211 are attached to each other. In this case, the seal layer 520 (530) may be cut and ground together with the at least one substrate.

As a result, as shown in (b) of FIG. 26, at least one of the front substrate 201 and the rear substrate 211 may be prevented from excessively protruding in a cutting and grinding portion. Further, the size of a portion SA on which an image is not displayed may be reduced. Even if a plurality of plasma display panels are successively positioned, the size of the seam portion may be prevented from excessively increasing.

As described above, because the size of the seam portion is reduced by reducing a length of at least one of the front substrate 201 and the rear substrate 211 through cutting and grinding processes in a state where the front substrate 201 and the rear substrate 211 are attached to each other using the seal layer 520(530), it may be preferable that the plasma display panel is used as the multi plasma display device compared with other display panels.

FIGS. 27 to 31 illustrate another configuration of a multi plasma display device according to an embodiment of the invention. Structures and components identical or equivalent to those illustrated above are designated with the same reference numerals, and a further description may be briefly made or may be entirely omitted.

Figure 27:
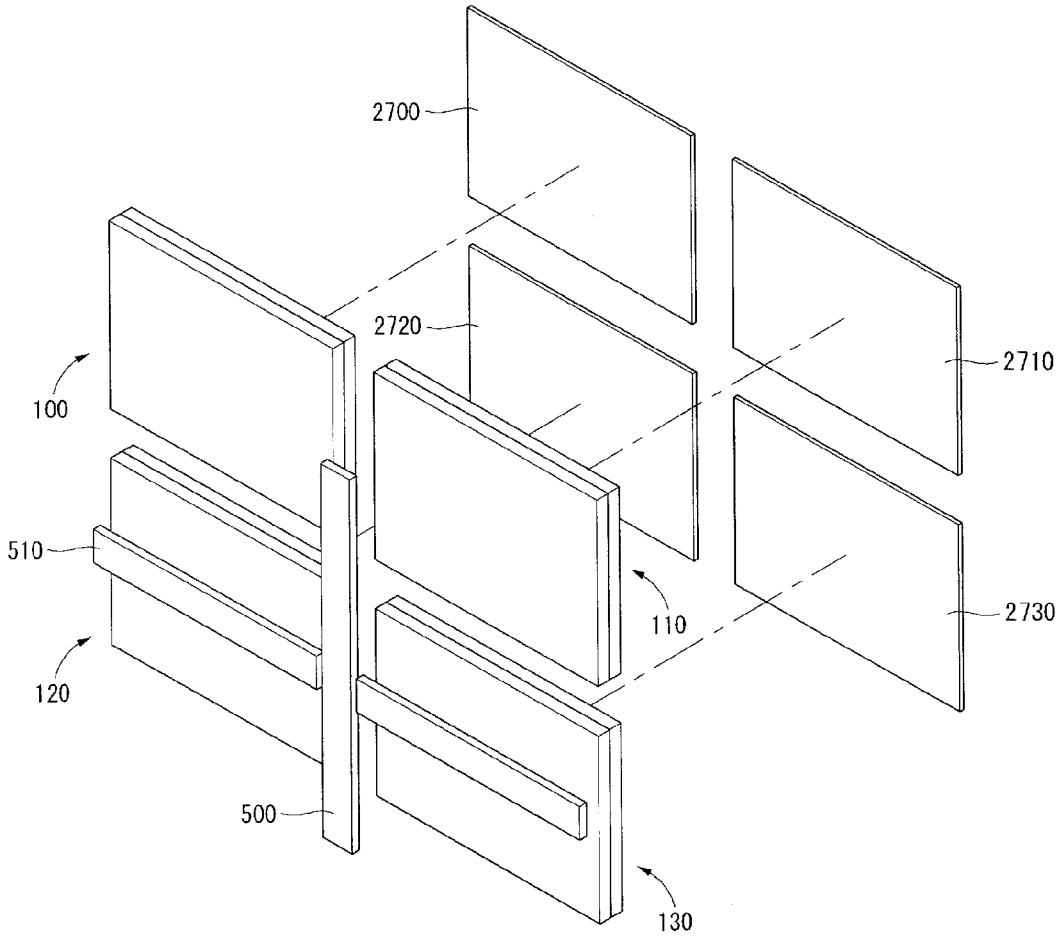
FIGS. 27 to 31 illustrate another configuration of a multi plasma display device according to an embodiment of the invention.

AS shown in FIG. 27, a multi plasma display device according to an embodiment of the invention may include a first main frame 2700 positioned in the rear of a first panel 100 (i.e., in the rear of a rear substrate of the first panel 100), a second main frame 2710 positioned in the rear of a second panel 110 (i.e., in the rear of a rear substrate of the second panel 110), a third main frame 2720 positioned in the rear of a third panel 120 (i.e., in the rear of a rear substrate of the third panel 120), and a fourth main frame 2730 positioned in the rear of a fourth panel 130 (i.e., in the rear of a rear substrate of the fourth panel 130). A driving board may be positioned in each of the first to fourth main frames 2700 to 2730 to supply a driving signal to each of the first to fourth panels 100 to 130.

In the multi plasma display device according to the embodiment of the invention, at least one of a plurality of adjacent plasma display panels may include a dummy discharge cell in a dummy area.

Figure 28:
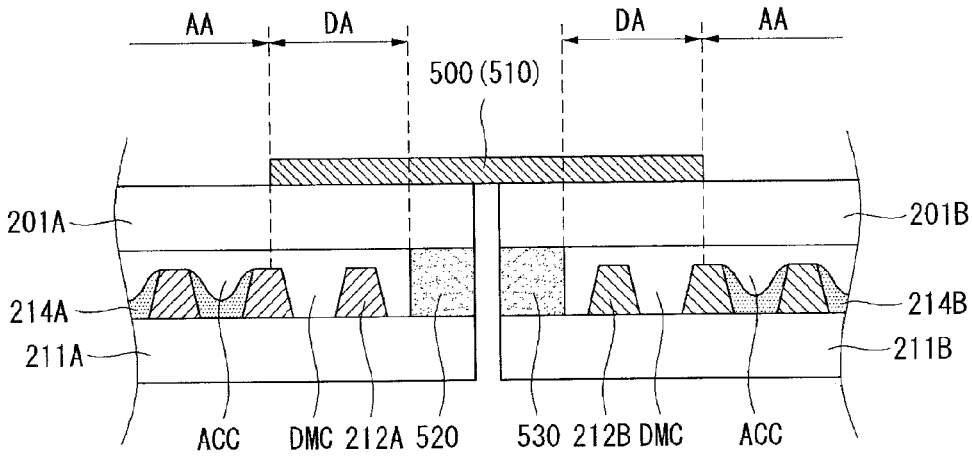

For example, as shown in FIG. 28, each of adjacent first and second panels may include a dummy discharge cell DMC in a dummy area DA. The dummy discharge cell DMC indicates a discharge cell in which an image is achieved. Phosphor layers 214A and 214B may not be formed in the dummy discharge cells DMC of the first and second panels as shown in FIG. 28. Alternatively, the phosphor layers 214A and 214B may be formed in the dummy discharge cells DMC of the first and second panels. A data signal may not be supplied to the dummy discharge cells DMC. Hence, even if the phosphor layers 214A and 214B are formed in the dummy discharge cells DMC, a discharge may not occur in the dummy discharge cells DMC. In other words, the dummy discharge cells DMC may allow a discharge to more stably occur in an outermost active discharge cell.

An optical sheet 500(510) may overlap at least one discharge cell of each of adjacent plasma display panels. Preferably, the optical sheet 500(510) may overlap seal layers 520 and 530 of adjacent first and second panels and a dummy discharge cell DMC in a dummy area DA of each of the adjacent first and second panels. The optical sheet 500(510) may not overlap an active discharge cell ACC in an active area AA inside the dummy area DA.

For example, one end of the optical sheet 500(510) may be positioned in a portion overlapping a barrier rib 212A of an outermost discharge cell in an active area AA of the first panel, and the other end of the optical sheet 500(510) may be positioned in a portion overlapping a barrier rib 212B of an outermost discharge cell in an active area AA of the second panel.

Figure 29:
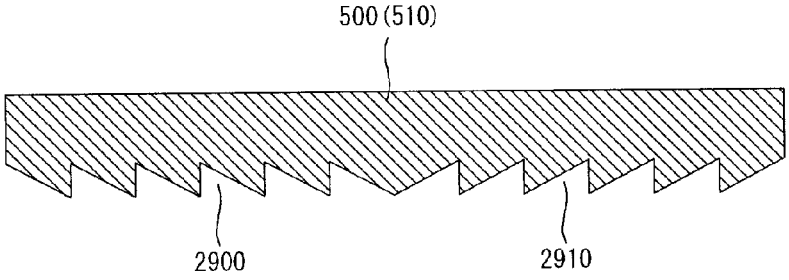
Figure 30:
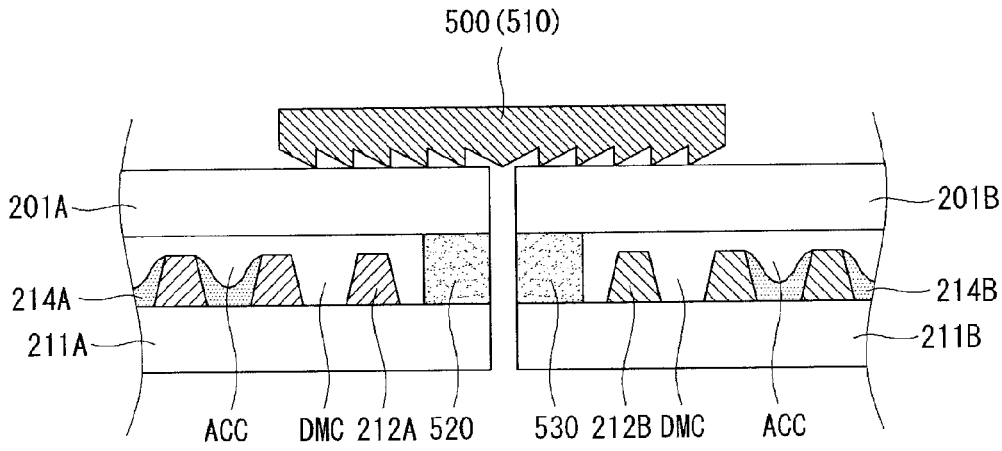

As shown in FIGS. 29 and 30, the optical sheet 500(510) may include a plurality of depressions 2900 and 2910. The optical sheet 500(510) shown in FIGS. 29 and 30 has a prism of depression form, compared with the optical sheet 500(510) having a prism of protruding form shown in FIG. 8.

Even in the optical sheet 500(510) shown in FIGS. 29 and 30, a boundary portion of at least two adjacent plasma display panels seem to be visually smaller than an actual size of the boundary portion.

In FIGS. 29 and 30, the first depression 2900 may correspond to the first protrusion 501 of FIG. 8, and the second depression 2910 may correspond to the second protrusion 502 of FIG. 8.

In the optical sheet 500(510) shown in FIGS. 29 and 30, a formation portion of the depressions 2900 and 2910 may be positioned toward a seam portion.

Figure 31:
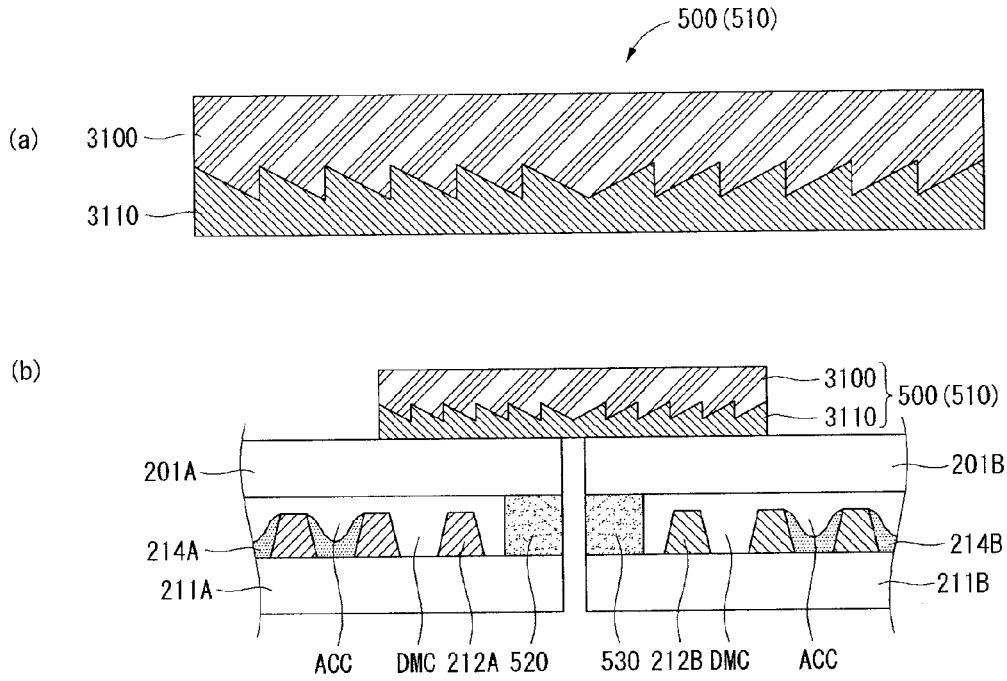

Alternatively, as shown in (a) of FIG. 31, the optical sheet 500(510) may include a first layer 3100 and a second layer 3110 having a stack structure. The first layer 3100 may include a first prism whose a surface is depressed, and the second layer 3110 may include a second prism whose a surface protrudes. The first layer 3100 and the second layer 3110 may be stacked, so that the first prism and the second prism engage each other.

Even in the optical sheet 500(510) shown in FIG. 31, a boundary portion of at least two adjacent plasma display panels seem to be visually smaller than an actual size of the boundary portion.

For this, as shown in (b) of FIG. 31, the second layer 3110 may be positioned in a boundary portion between the first and second panels, and the first layer 3100 may be positioned on the second layer 3110. Further, a refractive index of the first layer 3100 may be less than a refractive index of the second layer 3110.

Figure 32:
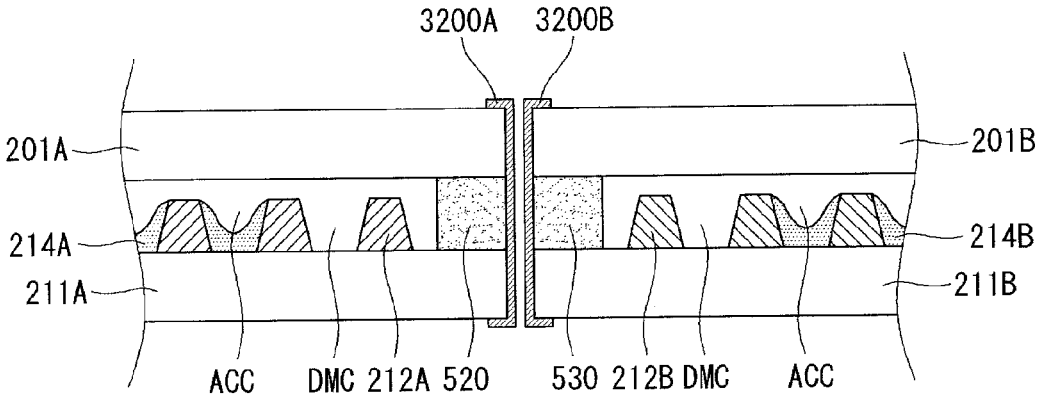
FIGS. 32 to 34 illustrate another configuration of a black layer.
Figure 33:
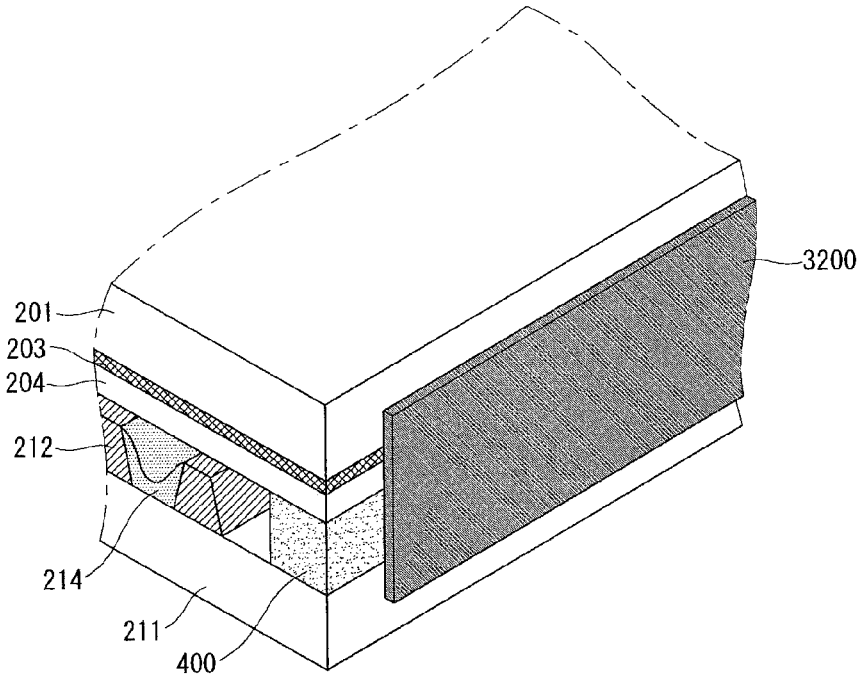
Figure 34:
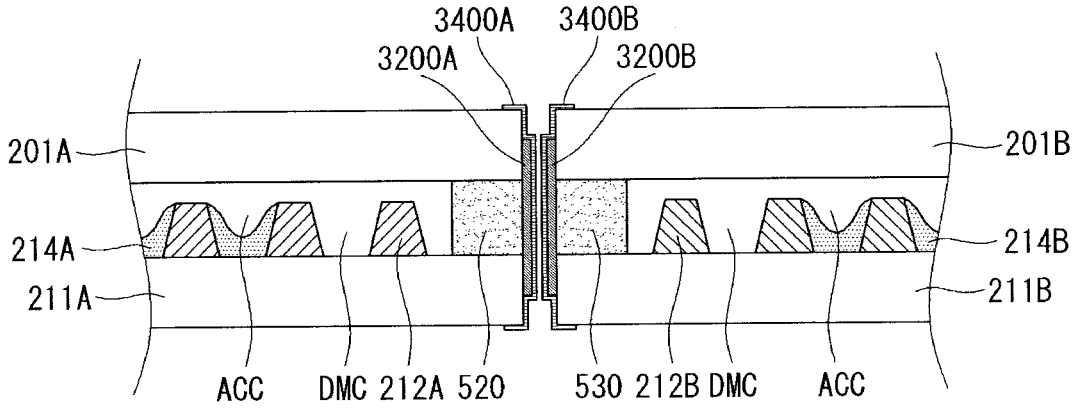

FIGS. 32 to 34 illustrate another configuration of a black layer.

As shown in FIG. 32, a black layer positioned in a boundary portion between a plurality of panels may be positioned at the side of at least one panel of the plurality of panels. For example, a first black layer 3200A may be positioned at the side of a first panel, and a second black layer 3200B may be positioned at the side of a second panel. The black layers 3200A and 3200B are attached to the sides of the first and second panels in form of sheet, respectively.

The fact that the black layers 3200A and 3200B are positioned at the side of the panel may indicate the black layers 3200A and 3200B are positioned at the sides of front substrates 201A and 201B, at the sides of rear substrates 211A and 211B, and at the sides of seal layers 520 and 530. Hence, light may be prevented from being reflected from the sides of the front substrates 201A and 201B, the sides of the rear substrates 211A and 211B, and the sides of the seal layers 520 and 530. As a result, the image quality may be improved.

Further, the black layers 3200A and 3200B may contain an electrically conductive material. In this case, the electromagnetic shielding layer on the front surface of the panel may be electrically connected to the main frame on the rear surface of the panel. In other words, the black layers 3200A and 3200B may ground the electromagnetic shielding layer.

Alternatively, as shown in FIG. 33, a width of a black layer 3200 may be smaller than a thickness of the panel. Hence, one end of the black layer 3200 may be positioned at the side of the front substrate 201, and the other end of the black layer 3200 may be positioned at the side of the rear substrate 211. In this case, a conductive layer may be positioned on the black layer 3200. For example, as shown in FIG. 34, a first black layer 3200A may be positioned at the side of a first panel, and a first conductive layer 3400A may be positioned on the first black layer 3200A. Further, a second black layer 3200B may be positioned at the side of a second panel, and a second conductive layer 3400B may be positioned on the second black layer 3200B.

In this case, the first conductive layer 3400A may electrically connect an electromagnetic shielding layer (not shown) on a front surface of the first panel to a main frame (not shown) on a rear surface of the first panel, and the second conductive layer 3400B may electrically connect an electromagnetic shielding layer (not shown) on a front surface of the second panel to a main frame (not shown) on a rear surface of the second panel. In other words, the conductive layers 3400A and 3400B may ground the electromagnetic shielding layers.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A multi plasma display device comprising:

a first panel;

a second panel positioned adjacent to the first panel; and a lens unit positioned so that the lens unit commonly overlaps a portion of a front surface of the first panel and a portion of a front surface of the second panel in a boundary portion between the first panel and the second panel, wherein each of the first panel and the second panel includes:

a front substrate;

a rear substrate positioned opposite the front substrate;

a barrier rib that is positioned between the front substrate and the rear substrate to partition a discharge cell; and a seal layer between the front substrate and the rear substrate, wherein the lens unit overlaps the seal layer of the first panel and the seal layer of the second panel and does not overlap the discharge cell of the first panel and the discharge cell of the second panel.

2. The multi plasma display device of claim 1, wherein the lens unit allows a size of the boundary portion between the first and second panels to seem to be smaller than an actual size of the boundary portion through an optical operation of the lens unit.

3. The multi plasma display device of claim 1, wherein one end of the lens unit is positioned between the seal layer and an outermost barrier rib of the first panel, and the other end is positioned between the seal layer and an outermost barrier rib of the second panel.

4. The multi plasma display device of claim 1, wherein one end of the lens unit is positioned in a portion overlapping an outermost barrier rib of the first panel, and the other end is positioned in a portion overlapping an outermost barrier rib of the second panel.

5. The multi plasma display device of claim 1, wherein the lens unit includes a plurality of protrusions on the surface of the lens unit.

6. The multi plasma display device of claim 5, wherein each of the plurality of protrusions has substantially a triangle shape.

7. The multi plasma display device of claim 5, wherein the lens unit includes a first portion overlapping the first panel and a second portion overlapping the second panel, wherein a shape of each of the protrusions formed in the first portion is different from a shape of each of the protrusions formed in the second portion.

8. The multi plasma display device of claim 1, wherein a width of the lens unit is greater than the size of the boundary portion.

9. The multi plasma display device of claim 1, wherein the lens unit includes a plurality of first prisms in a first portion overlapping the first panel and a plurality of second prisms in a second portion overlapping the second panel, wherein an angle between a first surface of the second prism adjacent to the first portion and a base of the lens unit is less than an angle between a second surface of the second prism opposite the first surface and the base of the lens unit, wherein an angle between a first surface of the first prism adjacent to the second portion and the base of the lens unit is less than an angle between a second surface of the first prism opposite the first surface and the base of the lens unit.

10. The multi plasma display device of claim 9, wherein a distance between a top of an outermost first prism of the first prisms and a top of an outermost second prism of the second prisms is greater than a distance between tops of two adjacent first prisms of the first prisms and a distance between tops of two adjacent second prisms of the second prisms in a boundary portion between the first portion and the second portion.

11. The multi plasma display device of claim 9, wherein the first prisms and the second prisms are arranged in opposite directions.

12. The multi plasma display device of claim 1, further comprising a black layer positioned in the boundary portion between the first panel and the second panel.

13. The multi plasma display device of claim 12, wherein the black layer is positioned at the side of at least one of the first panel and the second panel.

14. The multi plasma display device of claim 1, wherein a width of the lens unit is greater than a thickness of the lens unit, wherein a ratio of the width to the thickness of the lens unit is 10:1 to 10:8.

15. The multi plasma display device of claim 14, wherein the ratio of the width to the thickness of the lens unit is 10:2 to 10:6.

* * * * *